US009200791B2

(12) United States Patent
Noh et al.

(10) Patent No.: US 9,200,791 B2
(45) Date of Patent: Dec. 1, 2015

(54) LIGHTING APPARATUS HAVING RAIL UNIT

(71) Applicant: FEELUX CO., LTD., Gyeonggi-do (KR)

(72) Inventors: Si Chung Noh, Gyeonggi-do (KR); Beom Yeon Cho, Gyeonggi-do (KR); Jun Jang, Gyeonggi-do (KR); Ho Bok Hong, Gyeonggi-do (KR); Sang Il Gil, Gyeonggi-do (KR); Ha Young Jhun, Gyeonggi-do (KR); Doo Won Jang, Seoul (KR)

(73) Assignee: FEELUX CO., LTD., Gyeonggi-do (KR)

( * ) Notice: Subject to any disclaimer, the term of this patent is extended or adjusted under 35 U.S.C. 154(b) by 100 days.

(21) Appl. No.: 13/974,081

(22) Filed: Aug. 23, 2013

(65) Prior Publication Data

US 2014/0112001 A1 Apr. 24, 2014

(30) Foreign Application Priority Data

Oct. 19, 2012 (KR) ..... 10-2012-0116941
Jul. 18, 2013 (KR) ..... 10-2013-0085000

(51) Int. Cl.
*F21S 8/08* (2006.01)
*F21V 19/02* (2006.01)
(Continued)

(52) U.S. Cl.
CPC . *F21V 23/02* (2013.01); *F21S 2/00* (2013.01); *F21V 21/35* (2013.01); *F21V 23/005* (2013.01); *F21Y 2101/02* (2013.01)

(58) Field of Classification Search
CPC ..... F21V 23/005; F21V 23/02; F21V 21/35; F21Y 2101/02; F21S 2/00
USPC ..... 362/84, 145, 217.14, 249.1, 269, 285, 362/287, 648, 311.01, 418
See application file for complete search history.

(56) References Cited

U.S. PATENT DOCUMENTS 4,861,273 A * 8/1989 Wenman et al. ..... 439/111
7,322,735 B1 * 1/2008 Caldani ..... 362/648
2006/0039168 A1 * 2/2006 Mier-Langner et al. ..... 362/648
(Continued)

FOREIGN PATENT DOCUMENTS

CN 102192439 A * 9/2011
JP 2008-193840 A 8/2008
(Continued)

OTHER PUBLICATIONS

Machine English Translation of CN102192439A Sep. 2011.*
(Continued)

*Primary Examiner* — Anh Mai
*Assistant Examiner* — Glenn Zimmerman
(74) *Attorney, Agent, or Firm* — The PL Law Group, PLLC

(57) ABSTRACT

A lighting apparatus includes a rail unit, and an electric unit that is installed on the rail unit so as to be adjustable in position. The electric unit makes contact with the rail unit and receives power from the rail unit. In the lighting apparatus according to the present invention, a plurality of electric units can be installed on a rail unit so as to be adjustable in position, and even if the position of each electric unit is changed, power can be reliably supplied from the rail unit to the electric unit. Therefore, the present invention can be effectively used as lighting for several places, for instance, a place with a comparatively large area, or a place where intensely bright lighting is required.

17 Claims, 26 Drawing Sheets

(51) Int. Cl.

| | |
|---|---|
| ***F21V 23/02*** | (2006.01) |
| ***F21V 23/00*** | (2015.01) |
| ***F21S 2/00*** | (2006.01) |
| ***F21V 21/35*** | (2006.01) |
| *F21Y 101/02* | (2006.01) |

(56) References Cited

U.S. PATENT DOCUMENTS

| | | | | |
|---|---|---|---|---|
| 2009/0284988 | A1* | 11/2009 | Snagel et al. | 362/648 |
| 2011/0050073 | A1* | 3/2011 | Huang | 313/46 |
| 2013/0182422 | A1* | 7/2013 | Guilmette | 362/184 |

FOREIGN PATENT DOCUMENTS

| | | | |
|---|---|---|---|
| JP | 5002070 | B1 | 8/2012 |
| KR | 2007-0088110 | A | 8/2007 |
| KR | 2010-0090939 | A | 8/2010 |

OTHER PUBLICATIONS

European Search Report for 13188211.0, Oct. 21, 2014.

Office action from Korea Intellectual Property Office for the counterpart Korean patent application, Jul. 6, 2015.

* cited by examiner

LIGHTING APPARATUS HAVING RAIL UNIT

CROSS REFERENCE TO RELATED APPLICATIONS AND CLAIM OF PRIORITY

This application claims priority to Korean Patent Application No. 10-2012-0116941, filed on Oct. 19, 2012, and Korean Patent Application No. 10-2013-0085000, filed on Jul. 18, 2013 in the Korean Intellectual Property Office, the entire disclosure of which is incorporated herein by reference.

BACKGROUND

1. Field of the Invention

The present invention relates generally to lighting apparatuses and, more particularly, to a lighting apparatus that emits light.

2. Description of the Related Art

Generally, lighting apparatuses using LEDs can exhibit a high brightness effect with low power consumption. Therefore, LED lighting apparatuses can be used in a variety of ways, for example, as decorative lights, interior lamps, etc. Particularly, a typical fluorescent lamp LED lighting apparatus, which is configured in such a way that a cylindrical fluorescent cover is coupled to an aluminum main body in which an LED module and a printed circuit board (PCB) are mounted, was introduced.

A representative conventional technique related to the present invention was proposed in the Korean Patent Laid-open Publication No. 2009-0120885 (Date: Nov. 25, 2009, Title: LED light).

SUMMARY

Accordingly, the present invention has been made in consideration of the above problems manifested in the prior art, and an object of the present invention is to provide a lighting apparatus which is configured such that, even if the position of the lighting apparatus is changed, power can still be reliably supplied to the light apparatus, whereby a variety of types of lighting orientations can be realized.

In order to accomplish the above objective, the present invention provides a lighting apparatus, including a rail unit; and an electric unit installed on the rail unit so as to be adjustable in position, the electric unit making contact with the rail unit and receiving power from the rail unit.

The electric unit may include: a body unit movably coupled to the rail unit; a module unit installed in the body unit; and a power connector making contact with the rail unit and receiving power from the rail unit, the power connector supplying power to the module unit.

The module unit may include: a circuit board unit installed in the body unit, the circuit board making contact with the power connector and receiving power from the power connector; a light source unit installed on the circuit board unit, the light source unit emitting light; and a diffuser installed in the body unit, the diffuser diffusing the light emitted from the light source unit.

The module unit may include: a circuit board unit installed in the body unit, the circuit board making contact with the power connector and receiving power from the power connector; a connection unit installed on the circuit board unit, the connection unit receiving power from the circuit board unit; and a bracket installed on the body unit so that an external device is coupled to the bracket.

The rail unit may include: a guide rail to which the body unit is coupled; and an electrode provided on the guide rail, the electrode making contact with the power connector and supplying power to the power connector.

The body unit may include: a module installation body in which the module unit is installed; and a coupling cover coupling the module installation body to the rail unit.

The power connector may include: a first connection part electrically connected to the electrode; a second connection part electrically connected to the first connection part; and a third connection part electrically connected to the second connection part, the third connection part passing through the module installation body and being electrically connected to the module unit.

The guide rail may have a coupling depression formed in a side surface of the guide rail. The coupling depression may extend along a longitudinal direction of the guide rail. The coupling cover may include: a body coupling part coupled to the module installation body; a first rail coupling part provided in such a way that the first rail coupling part encloses an outer surface of the guide rail; and a second rail coupling part extending and bending from the first rail coupling part, the second rail coupling part being coupled to the coupling depression.

The body unit may further include a pressure cover installed on the coupling cover, the pressure cover compressing the first and second rail coupling parts towards the coupling depression.

The pressure cover may include: a sliding coupling part slidably coupled to the coupling cover so that the pressure cover can be moved to a pressure position or a pressure release position; and a pressure protrusion protruding towards the first rail coupling part, the pressure protrusion coming into contact with the first rail coupling part in conjunction with sliding movement of the sliding coupling part and compressing the first rail coupling part towards the coupling depression.

The electric unit may include: a power supply unit coupled to the rail unit, the power supply unit making contact with the rail unit and receiving power from the rail unit; and a lighting unit connected to the power supply unit so as to be adjustable in angle.

The electric unit may include: a first body unit movably coupled to the rail unit; a second body unit rotatably coupled to the first body unit; a module unit installed in the second body unit; and a power connector making contact with the rail unit and receiving power from the rail unit, the power connector supplying the power to the module unit. The power connector may include: a first connection part installed in the first body unit and electrically connected to the rail unit; and a second connection part installed in the second body unit, the second connection part having a first end making slidable contact with the first connection part, and a second end electrically connected to the module unit.

The electric unit may include: a body unit movably coupled to the rail unit; a power distribution unit installed on the body unit, the power distribution unit being connected to an external device to supply power to the external device; and a power connector making contact with the rail unit and receiving power from the rail unit, the power connector supplying the power to the power distribution unit.

The rail unit may comprise a plurality of rail units. The lighting apparatus may further include a coupler coupling the rail units to each other.

The lighting apparatus may further include a power cord unit making contact with the rail unit and supplying power to the rail unit.

In a lighting apparatus according to the present invention, a plurality of electric units can be installed on a rail unit so as to be adjustable in position, and even if the position of each electric unit is changed, power can be reliably supplied from the rail unit to the electric unit. Therefore, the present invention can be effectively used as lighting apparatus for several places, for instance, a place with a comparatively large area requiring lighting, or a place where intensely bright lighting is required.

Furthermore, the present invention can provide a lighting apparatus which not only has a structure in which power can be reliably supplied to the electric unit, but also one that has a stylish and simple appearance. Furthermore, a separate element, such as a wire, is not required for installation of the electric unit so that the problem of interference between the electric unit and the separate element can be avoided, allowing adjustment of the lighting position which can be facilitated and precisely conducted.

Moreover, in the present invention, lighting can be realized such that light is provided to a desired area at a desired angle. In addition, the lighting apparatus of the present invention can be easily installed on a target surface without being excessively constrained by the conditions of the target surface. Further, the lighting apparatus can function not only as a lighting apparatus, but also as a means for charging at various positions without being limited to a specific position. Therefore, the lighting apparatus according to the present invention can be more convenient for users.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
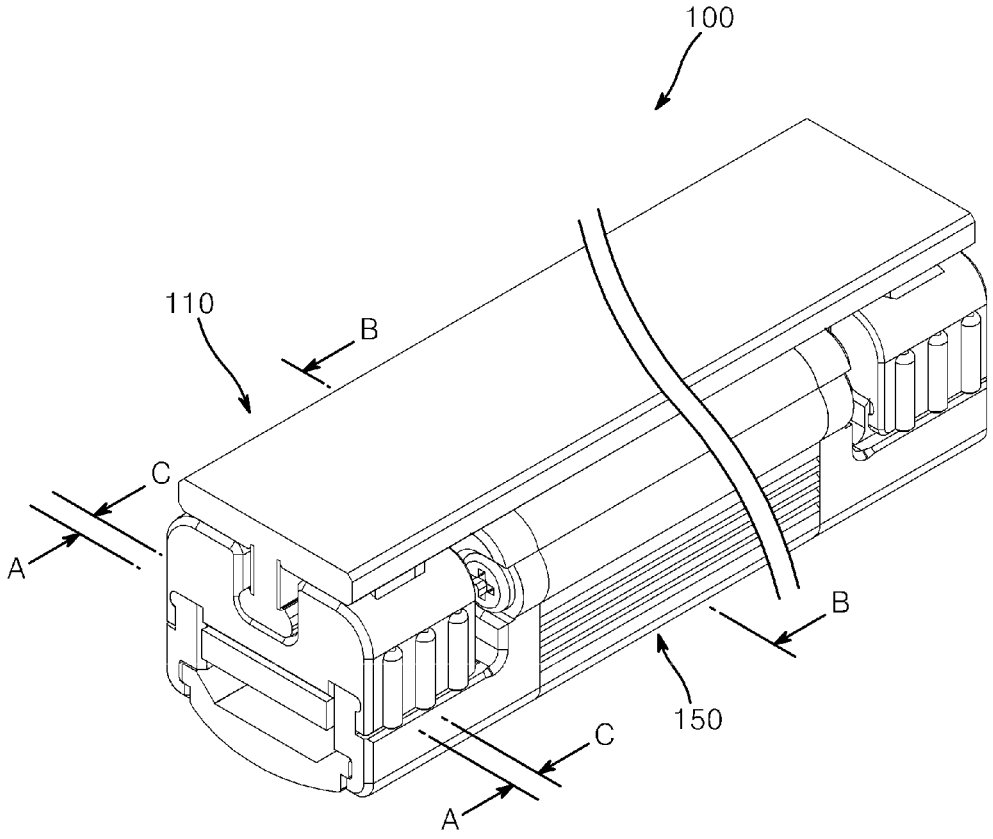
FIG. 1 is a perspective view illustrating a lighting apparatus, according to a first embodiment of the present invention.

Hereinafter, preferred embodiments of the present invention will be described in detail with reference to the attached drawings. For reference, the size of each element, the thickness of lines illustrating the element, etc. may be exaggerated in the drawings for the sake of understanding the present invention. The terms and words used for elements in the description of the present invention have been determined in consideration of the functions of the elements in the present invention. The terms and words may be modified depending on the intention or customization of users or operators, hence they must be defined based on the entire content of the specification of the present invention.

Figure 2:
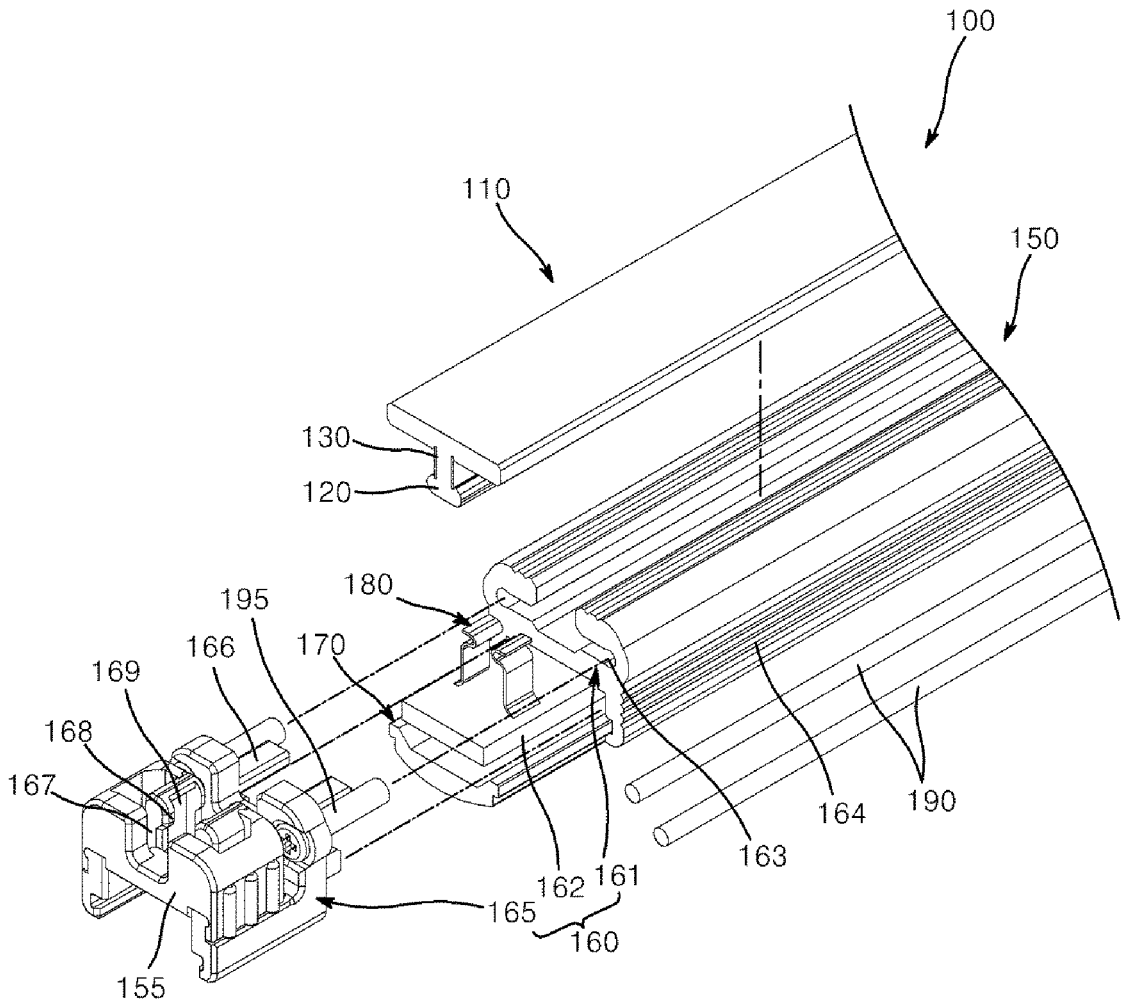
FIG. 2 is an exploded perspective view of the lighting apparatus of FIG. 1.
Figure 3:
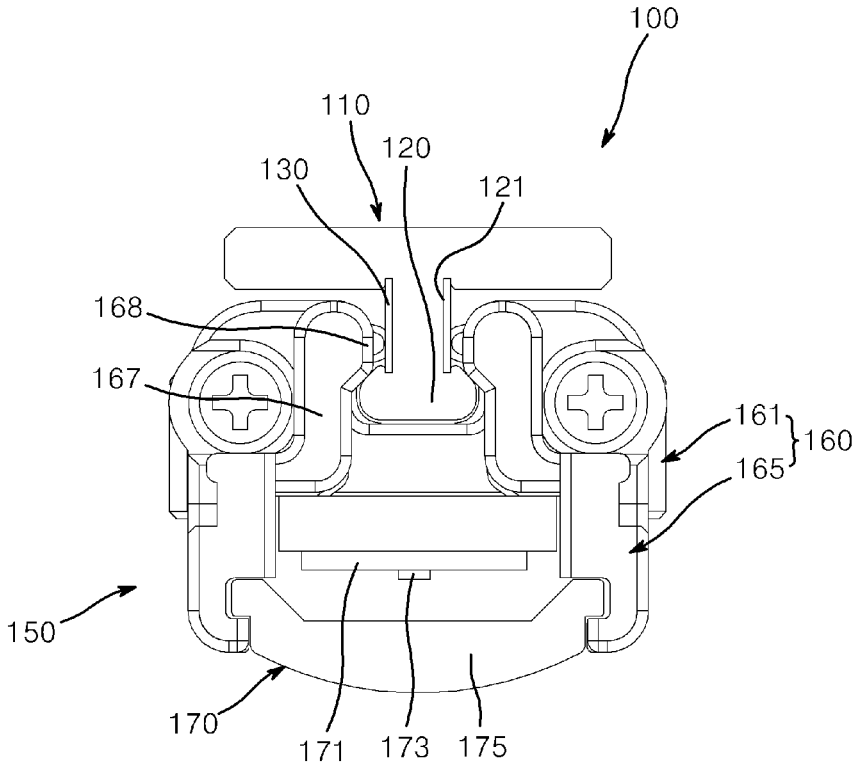
FIG. 3 is a sectional view taken along line A-A of FIG. 1.
Figure 4:
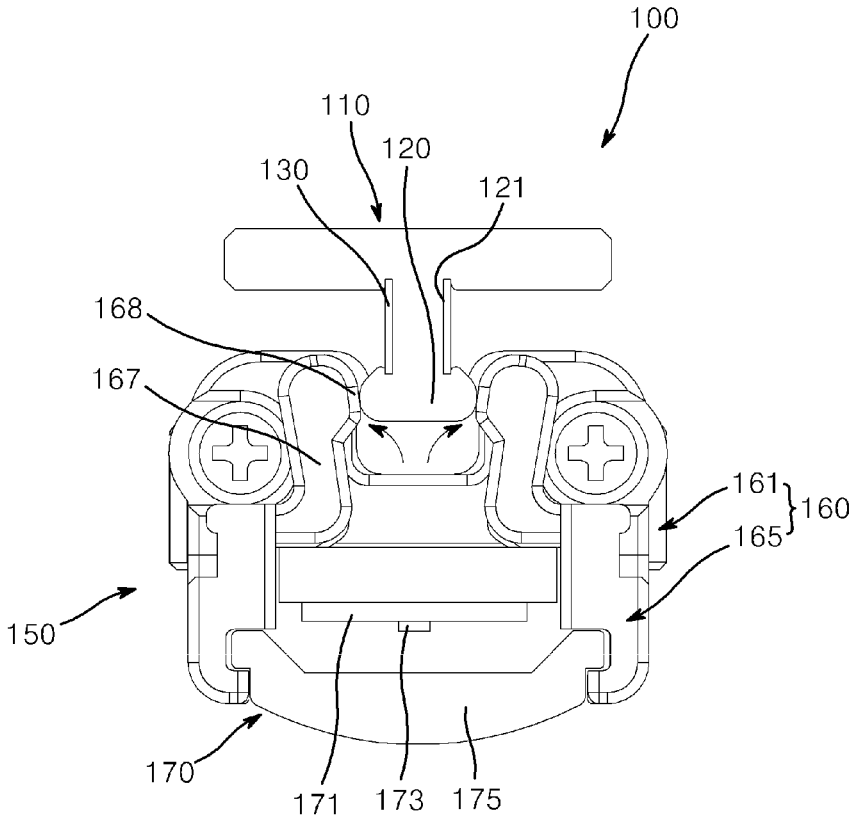
FIG. 4 is a sectional view showing a process of coupling a coupling cover to a guide rail of FIG. 3.
Figure 5:
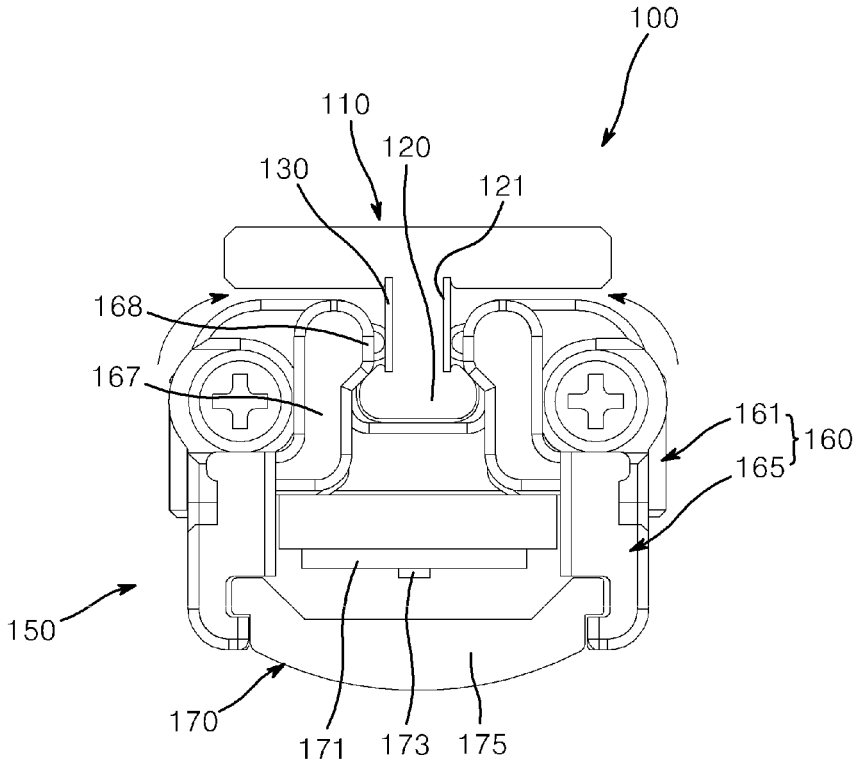
FIG. 5 is a sectional view showing the coupling between the coupling cover and the guide rail of FIG. 4.
Figure 6:
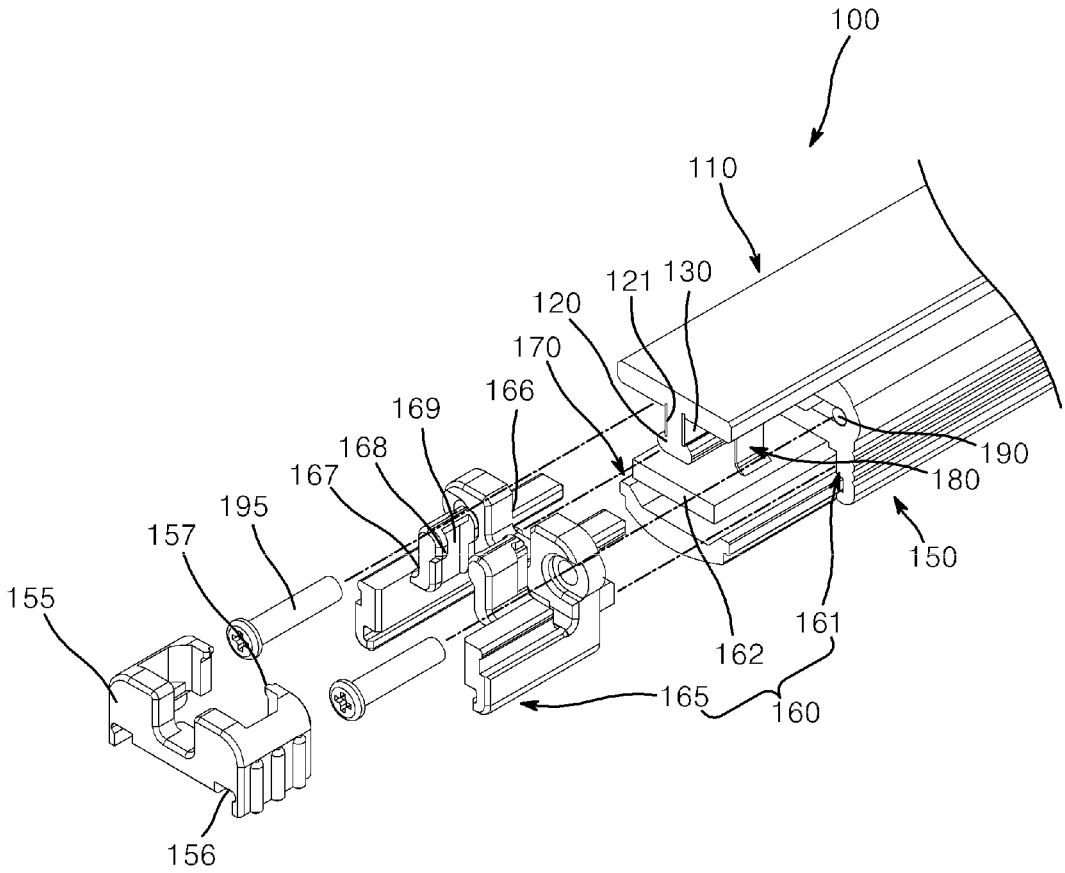
FIG. 6 is an exploded perspective view showing the coupling cover and a pressure cover part of the lighting apparatus of FIG. 1.
Figure 7:
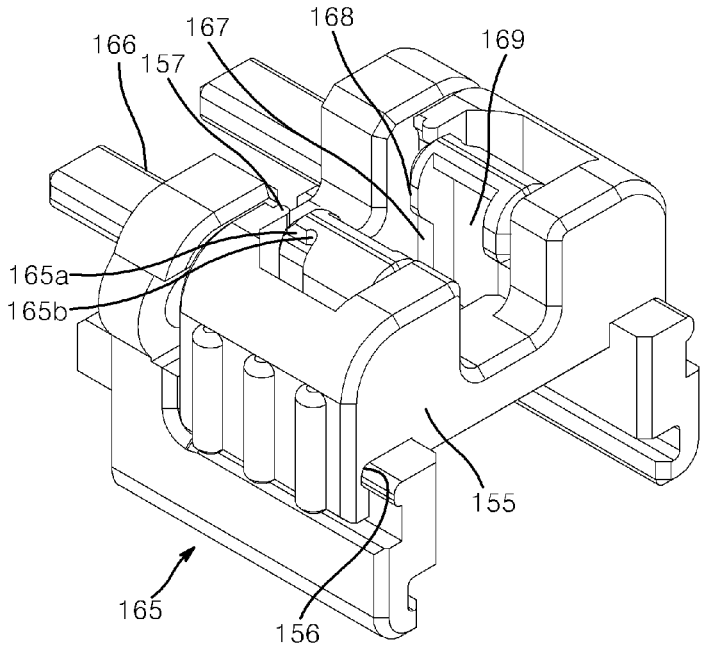
FIG. 7 is a view illustrating a process of coupling the coupling cover to the pressure cover part of FIG. 6.
Figure 8:
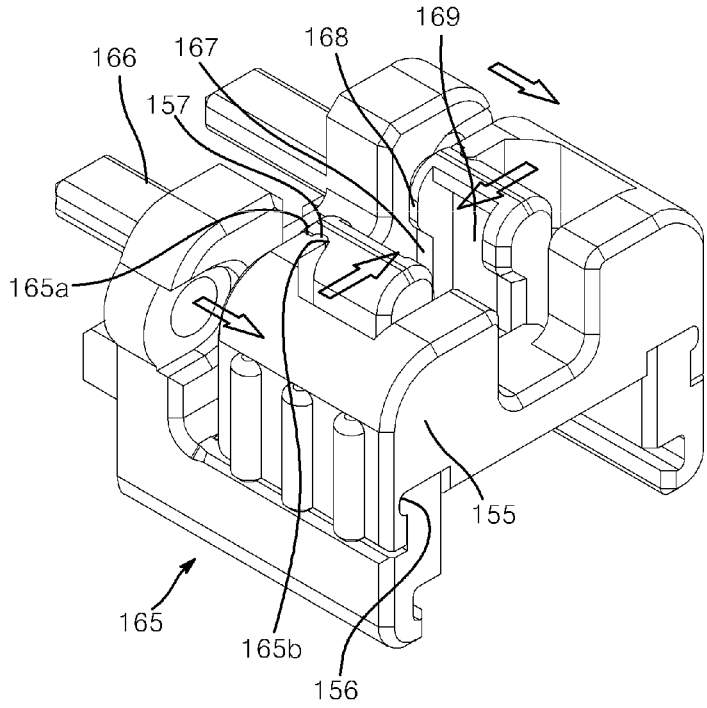
FIG. 8 is a view showing the coupling between the coupling cover and the pressure cover part of FIG. 7.
Figure 9:
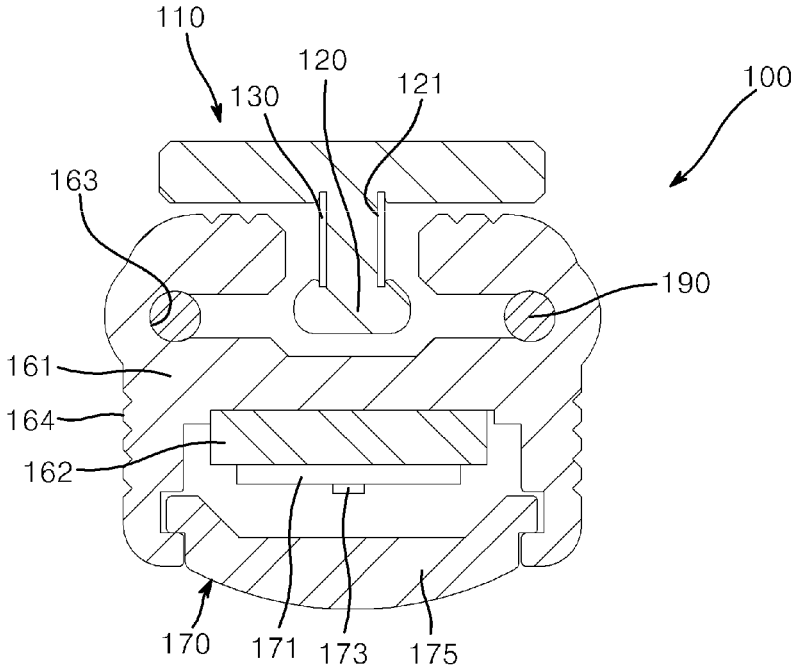
FIG. 9 is a sectional view taken along line B-B of FIG. 1.
Figure 10:
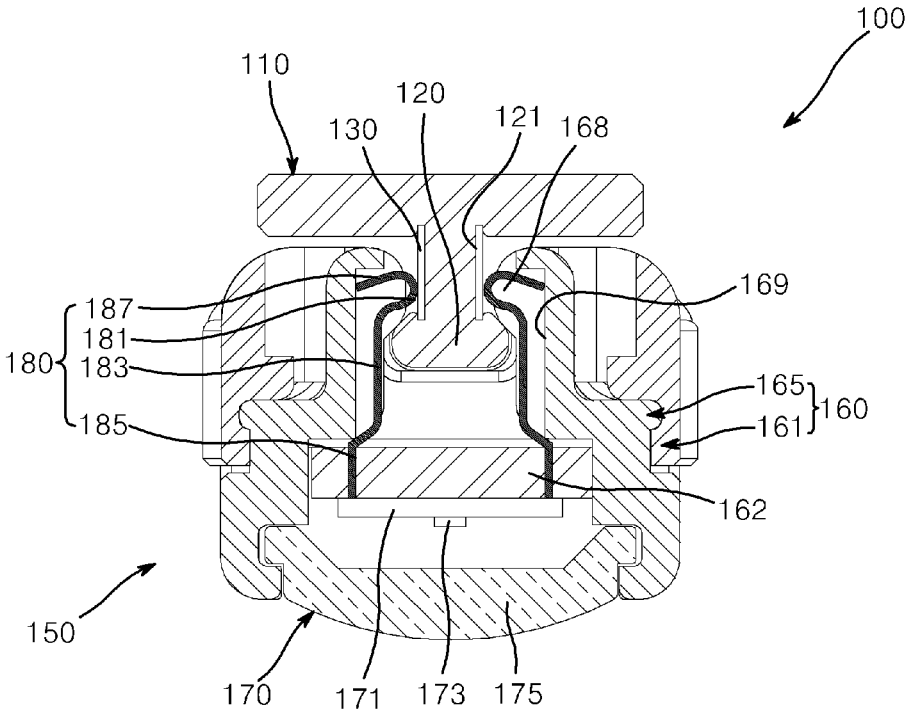
FIG. 10 is a sectional view taken along line C-C of FIG. 1.

FIG. 1 is a perspective view illustrating a lighting apparatus according to a first embodiment of the present invention. FIG. 2 is an exploded perspective view of the lighting apparatus of FIG. 1. FIG. 3 is a sectional view taken along line A-A of FIG. 1. FIG. 4 is a sectional view showing a process of coupling a coupling cover to a guide rail of FIG. 3. FIG. 5 is a sectional view showing the coupling between the coupling cover and the guide rail of FIG. 4. FIG. 6 is an exploded perspective view showing the coupling cover and a pressure cover part of the lighting apparatus of FIG. 1. FIG. 7 is a view illustrating a process of coupling the coupling cover to the pressure cover part of FIG. 6. FIG. 8 is a view showing the coupling between the coupling cover and the pressure cover part of FIG. 7. FIG. 9 is a sectional view taken along line B-B of FIG. 1. FIG. 10 is a sectional view taken along line C-C of FIG. 1.

Referring to FIGS. 1 and 2, the lighting apparatus 100 according to the first embodiment of the present invention includes a rail unit 110 and an electric unit 150.

The rail unit 110 is used for installation, positional adjustment, and power supply of the electric unit 150. The rail unit 110 includes a guide rail 120 and electrodes 130.

The guide rail 120 is configured to be fastened to a structure (not shown) on which the lighting apparatus 100 is installed. In this embodiment, although the lighting apparatus 100 is illustrated as being installed, for instance, on the ceiling of a building, the installation position of the lighting apparatus 100 is not limited to the ceiling of a building, and can be modified in a variety of ways. For instance, the lighting apparatus 100 may be installed on other structures such as furniture, walls, floors, etc.

The electric unit 150 is removably coupled to the guide rail 120. A coupling depression 121 is formed in each of both side surfaces of the guide rail 120. The coupling depression 121, which is formed in each side surface of the guide rail 120, extends in a longitudinal direction of the guide rail 120. As such, the guide rail 120 that has the coupling depressions 121 in both side surfaces thereof, generally has an "I"-shaped cross-section. Preferably, the guide rail 120 is made of non-conductive material The electrodes 130 are installed on the guide rail 120. In this embodiment, the electrodes 130 are disposed in the respective coupling depressions 121 which are formed in the side surfaces of the guide rail 120. Each electrode 130 extends in the longitudinal direction of the guide rail 120 to a length corresponding to that of the guide rail 120.

The electrodes 130 are electrically connected to an external power supply (not shown) so that electric power is supplied to the electrodes 130. The electrodes 130 are brought into contact with and are electrically connected to power connectors 180 of the electric unit 150 which will be explained herein (vida infra). The electrodes 130 function to supply power to the electric unit 150 which is removably coupled to the rail unit 110. In this embodiment, each electrode 130 is a metal plate made of aluminum.

The electric unit 150 is installed on the rail unit 110 so as to be adjustable in position in the longitudinal direction of the rail unit 110. The electric unit 150 is brought into contact with the rail unit 110, specifically, with the electrodes 130 so that electricity can be supplied to the electric unit 150. The electric unit 150 includes a body unit 160, a module unit 170 and the power connectors 180.

The body unit 160 is removably coupled to the rail unit 110. The body unit 160 is made of non-conductive material and includes a module installation body 161 and coupling covers 165.

The module unit 170 is installed in the module installation body 161. A board mounting part 162 is formed in the module installation body 161 so that a circuit board unit 171 of the module unit 170 is installed in the board mounting part 162.

The coupling covers 165 removably couple the module installation body 161 to the rail unit 110. The coupling covers 165 are coupled to respective opposite ends of the module installation body 161 with respect to the longitudinal direction and are removably coupled to the rail unit 110. Each coupling cover 165 includes a body coupling part 166, a first rail coupling part 167 and second rail coupling parts 168.

The body coupling parts 166 of the coupling covers 165 are coupled to the respective opposite ends of the module installation body 161 with respect to the longitudinal direction. Each body coupling part 166 is coupled to the module installation body 161 by inserting a fitting protrusion (not designated by reference numeral) into a fitting hole (not designated by reference numeral) which are respectively provided in the body coupling part 166 and the module installation body 161, whereby each coupling cover 165 can be coupled to the module installation body 161.

Referring to FIGS. 3 and 4, the first rail coupling part 167 is configured in such a way that it encloses the guide rail 120. The second rail coupling parts 168 are bent from the first rail coupling part 167 towards the side surfaces of the guide rail 120, and are coupled to the respective coupling depressions 121.

As such, the coupling cover 165 engages with the guide rail 120 in such a way that the coupling cover 165 covers the outer surface of the guide rail 120, whereby the coupling cover 165 and the guide rail 120 are removably coupled to each other. Here, because the second rail coupling parts 168 are inserted into the respective coupling depressions 121, the coupling cover 165 can be prevented from being undesirably removed from the guide rail 120.

The coupling cover 165, having the above-mentioned construction, is coupled to the module installation body 161 using the body coupling part 166, and is coupled to the guide rail 120 using the first and second rail coupling parts 167 and 168, whereby the body unit 160, including the module installation body 161, can be removably coupled to the rail unit 110.

The coupling cover 165, particularly, the first rail coupling part 167, is preferably made of elastic material. As shown in FIG. 4, the coupling cover 165 can be fitted over the guide rail 120 in such a way that the internal space of the first rail coupling part 167 is elastically widened. As shown in FIG. 5, the removable coupling of the coupling cover 165 to the guide rail 120 is completed when the first rail coupling part 167, which had been widened, is returned to its original state by its own elasticity.

By virtue of the removable coupling of the coupling cover 165 to the guide rail 120, the body unit 160 and the electric unit 150 can be removably coupled to the rail unit 110.

The electric unit 150, which is removably coupled to the rail unit 110, can be adjusted in position along the longitudinal direction of the rail unit 110. That is, the electric unit 150, which has been installed on the rail unit 110 at a predetermined position with respect to the longitudinal direction of the rail unit 110, can be removed from the rail unit 110 and re-installed on the rail unit 110 at an alternate position.

Referring to FIGS. 2 and 7, the body unit 160 further includes a pressure cover 155. The pressure cover 155 is installed on the coupling cover 165 so as to press the first and second rail coupling parts 167 and 168 towards the coupling depressions 121. The pressure cover 155 includes a sliding coupling part 156 and a pressure protrusion 157.

Referring to FIG. 8, the sliding coupling part 156 is slidably coupled to the coupling cover 165 so that the pressure cover 155 can be movably coupled to the coupling cover 165. By virtue of the sliding coupling part 156, the pressure cover 155 can move to a pressure position at which the first and second rail coupling parts 167 and 168 are pressed towards the coupling depressions 121, or to a release position at which the first and second rail coupling parts 167 and 168, which have been pressed, are released.

The pressure protrusion 157 is provided in the pressure cover 155 in such a way that the pressure protrusion 157 protrudes towards the first rail coupling part 167. The pressure protrusion 157 is moved to the pressure position or the release position in conjunction with sliding movement of the sliding coupling part 156. When the pressure protrusion 157 moves to the pressure position, it makes contact with the first rail coupling part 167, thus pressing the first rail coupling part 167 towards the coupling depressions 121.

A sliding depression **165*a* is formed in a portion of the first rail coupling part 167 that makes contact with the pressure protrusion 157, whereby the pressure protrusion 157 can smoothly slide on the first rail coupling part 167. That is, the pressure protrusion 157 can smoothly move in the sliding depression 165*a* in conjunction with the sliding of the pressure cover 155, so that the first rail coupling part 167 can be more smoothly pressed towards the coupling depressions 121. Furthermore, the pressure protrusion 157, which presses the first rail coupling part 167, is seated into the locking groove 165*b* which is formed in an end of the sliding depression 165*a*, thus locking the pressure cover 155 to the coupling cover 165**.

Because of the pressing of the first rail coupling part 167, the first and second rail coupling parts 167 and 168 are pressed towards the coupling depressions 121, whereby the coupling between the coupling cover 165 and the guide rail 120 become more reliable.

Referring to FIGS. 2 and 3, the module unit 170 is installed in the module installation body 161 of the body unit 160. The module unit 170 includes the circuit board unit 171, a light source unit 173 and a diffuser 175.

The circuit board unit 171 is installed in the module installation body 161. In this embodiment, the circuit board unit 171 includes a PCB. Different kinds of circuit components are mounted to the circuit board unit 171 so as to drive the light source unit 173 that is installed on the circuit board unit 171.

The circuit board unit 171 is brought into contact with and is electrically connected to the power connectors 180 which protrude towards the circuit board unit 171 from the board mounting part 162, so that power for driving the light source unit 173 is supplied to the circuit board unit 171 through the power connectors 180 (refer to FIG. 10).

The light source unit 173 is installed on the circuit board unit 171 and emits light. The light source unit 173 includes at least one light emitting body. The light emitting body of the light source unit 173 is either an LED or an OLED.

The diffuser 175 is installed in the module installation body 161 in such a way that the light source unit 173 installed in the module installation body 161 is disposed inside the diffuser 175. The diffuser 175 functions to diffuse light emitted from the light source unit 173.

As shown in FIGS. 2 and 9, the electric unit according to this embodiment may further include heat dissipation members 190. The heat dissipation members 190 are installed in the module installation body 161 of the body unit 160 in such a way that the heat dissipation members 190 are inserted into respective heat dissipation member installation spaces 163 which are formed in side portions of the module installation body 161.

In this embodiment, each heat dissipation member 190 extends a predetermined length in the longitudinal direction of the electric unit 150 and is made of a metal, such as aluminum, which has high thermal conductivity. The heat dissipation members 190 function to dissipate heat generated from the module unit 170, thus preventing the light source unit 173 from deteriorating due to heat.

Heat dissipation parts 164 are further formed on the body unit 160 at positions adjacent to the heat dissipation members 190 and the heat dissipation member installation spaces 163. Each heat dissipation part 164 functions to increase a surface area of the body unit 160, which makes contact with the outside air, so that the heat dissipation effect of the corresponding heat dissipation member 190 can be further enhanced.

In this embodiment, the heat dissipation parts 164 are illustrated as being configured in such a way that protrusions are provided on the outer surface of the module installation body 161. Alternatively, the heat dissipation parts 164 may be configured in such a way that holes (not shown) are formed in the module installation body 161.

Meanwhile, the electric unit 150 according to this embodiment may further include a coupling part 195. The coupling part 195 functions to reliably couple the coupling cover 165 to the module installation body 161.

Referring to FIGS. 2 and 10, the power connectors 180 are installed in the body unit 160. The power connectors 180 make contact with the respective electrodes 130 of the rail unit 110 and transmit power from the electrodes 130 to the module unit 170. Each power connector 180 includes a first connection part 181, a second connection part 183 and a third connection part 185.

The first connection part 181 is electrically connected to the corresponding electrode 130. In detail, the first connection part 181 is electrically connected to the electrode 130 in such a way that the first connection part 181 makes contact with the electrode 130. The first connection part 181 extends from the second connection part 183 such that the first and second connection parts 181 and 183 are electrically connected to each other.

In this embodiment, the first connection part 181 is bent from the second connection part 183. The first connection part 181, which has a bent structure, applies elastic force to the power connector 180 so that the first connection part 181 is brought into close contact with the electrode 130. The first connection part 181 is brought into close contact with the electrode 130 by the elastic force applied to the power connector 180.

The third connection part 185 is electrically connected to the second connection part 183. The third connection part 185 is inserted into and coupled to the board mounting part 162. In detail, the third connection part 185 is disposed in the board mounting part 162 of the module installation body 161 and is exposed to the outside from the board mounting part 162 towards the circuit board unit 171. The third connection part 185 comes into contact with the circuit board unit 171 of the module unit 170, thus making electrical connection to the circuit board unit 171.

The coupling cover 165 has support depressed parts 169 in the inner surface thereof. That is, the support depressed parts 169 are formed in the coupling cover 165, specifically, in the first and second rail coupling parts 167 and 168, such that portions of the power connectors 180 are disposed in the respective support depressed parts 165.

Each support depressed part 169 receives a portion of the corresponding power connector 180 therein and thus fixes the position of the power connector 180. Furthermore, the support depressed part 169 supports the power connector 180 such that the first connection part 181 is brought into close contact with the electrode 130, thus making the electrical connection between the power connector 180 and the electrode 130 via the first connection part 181 more reliable.

In this embodiment, the first through third connection parts 181, 183, and 185 are made of copper and are integrally formed into a single body. The power connector 180, including the first through third connection parts 181, 183, and 185, generally has an "L" shape. The power connector 180 receives power from the electrode 130 and transmits it to the module unit 170. The power connector 180, having the above-mentioned structure, functions to make it possible to supply power to the module unit 170 regardless of variation in position of the electric unit 150 by coupling the rail unit 110 to the electric unit 150.

Furthermore, a bent part 187 is formed on an end of the first connection part 181, which makes contact with the electrode 130. The bent part 187 is bent from the end of the first connection part 181 and extends a predetermined length. The bent part 187 restricts the power connector 180 from being expanded by heat generated from the module unit 170, or heat generated by making contact between the power connector 180 and the electrode 130.

In this embodiment, a plurality of power connectors 180 may be provided in the electric unit 150 with respect to the longitudinal direction of the electric unit 150. For instance, the two power connectors 180 may be arranged in the longitudinal direction of the electric unit 150 at positions spaced apart from each other by a predetermined distance. As such, in the case of the electric unit 150 that has several power connectors 180, even if one or more of the power connectors 180 either malfunction or are defective, power can be supplied to the module unit 170 through the other power connectors 180. Therefore, the supply of power to the module unit 170 will be more reliable.

Figure 11:
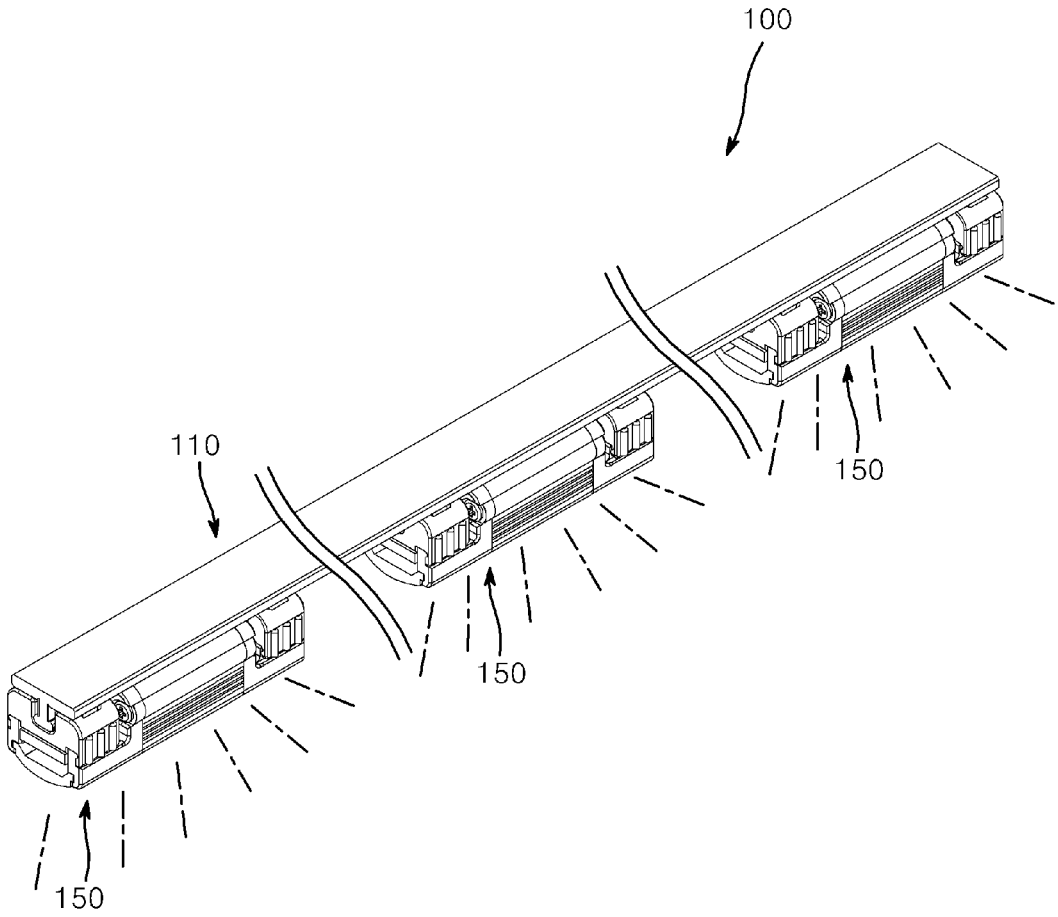
FIGS. 11 and 12 are views showing examples of the lighting apparatus in use according to the first embodiment of the present invention.
Figure 12:
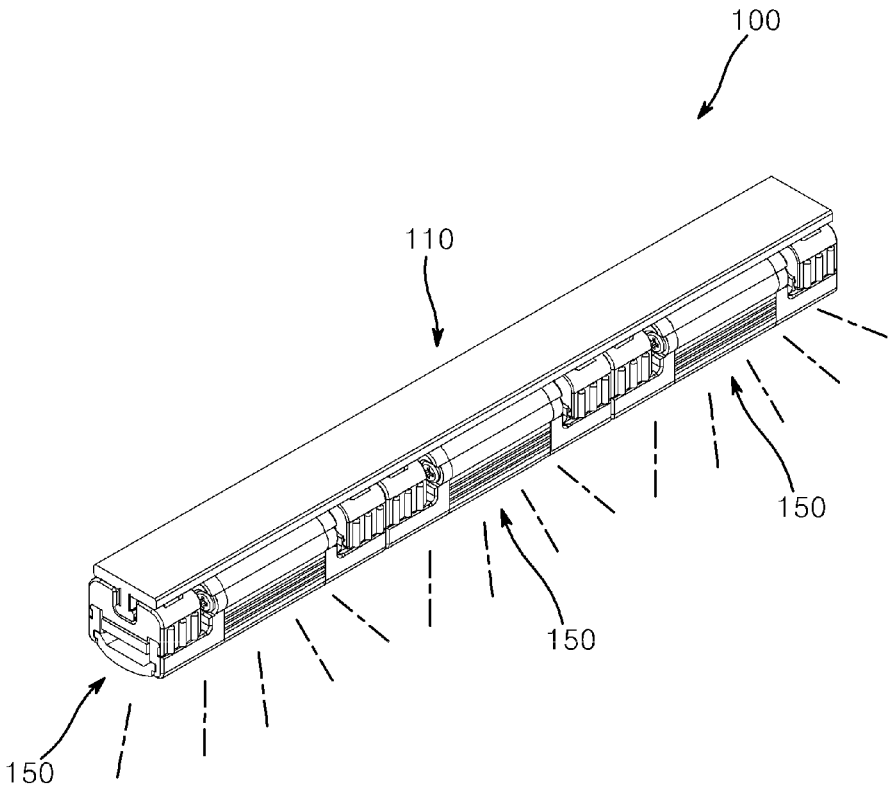
Figure 13:
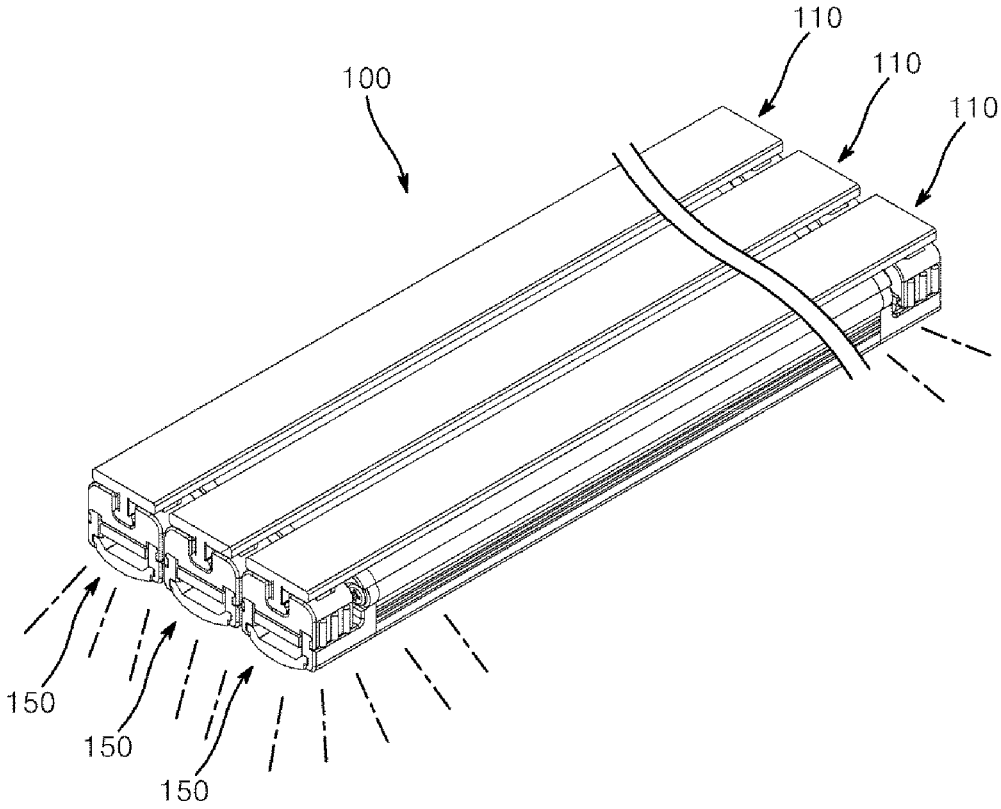
FIG. 13 is a view showing another example of the lighting apparatus in use according to the first embodiment of the present invention.

FIGS. 11 and 12 are views showing examples of the lighting apparatus in use according to the first embodiment of the present invention. FIG. 13 is a view showing another example of the lighting apparatus in use according to the first embodiment of the present invention.

Hereinafter, the operation and effects of the lighting apparatus according to the first embodiment of the present invention will be described with reference to FIGS. 10 through 13.

Referring to FIG. 10, the rail unit 110 is installed on a structure such as a ceiling of a building, and the electric unit 150 is installed on the rail unit 110 so as to be adjustable in position with respect to the longitudinal direction of the rail unit 110. In other words, the installation position of the electric unit 150 can be varied with respect to the longitudinal direction of the rail unit 110. Therefore, a user can easily change the position of the electric unit 150 to a place where lighting is required. The supply of power to the electric unit 150 is realized by the following connection structure.

Referring to FIGS. 8 and 10, power supplied from the external power supply (not shown) is supplied to the electrodes 130 through electric wires (not shown) that connect the external power supply to the electrodes 130. Power supplied to the electrodes 130 is applied to the power connectors 180 which are brought into contact with the electrodes 130 and are electrically connected to the electrodes 130.

The power connectors 180 are electrically connected to the electrodes 130 in such a way that the first connection parts 181 make contact with the respective electrodes 130. By this connection between each first connection part 181 and the corresponding electrode 130, the power connectors 180 can receive power from the electrodes 130 at any position of the rail unit 110 where the electrodes 130 are installed.

Power is transmitted from the power connectors 180 to the module unit 170, which is electrically connected to the power connectors 180 in such a way that the third connection parts 185 make contact with the circuit board unit 171. The module unit 170, which receives power from the power connectors 180 in the above-mentioned manner, can effectively embody lighting with the power being reliably supplied to the module unit 170 regardless of variation in the position of the electric unit 150.

Referring to FIG. 11, a plurality of electric units 150 may be arranged in the longitudinal direction of the rail unit 110. Each electric unit 150 is installed on the rail unit 110 so as to be adjustable in position, and power can be supplied from the rail unit 110 to the electric unit 150 by electrical connection between the electrodes 130 and the power connectors 180.

In the case of the lighting apparatus 100 provided with the electric units 150, the electric units 150 are respectively disposed at a plurality of places where lighting is required, so that lighting can be realized in each place.

Furthermore, as shown in FIG. 12, the lighting apparatus 100 may be configured such that two or more electric units 150 are arranged close to each other in a place where bright lighting is required. In this way, brighter lighting can be provided to a desired place. Several electric units 150, which are arranged close to each other, may be coupled to each other in such a way that the electric units 150 are brought into close contact with each other so that lighting can be continuously formed, in other words, can be continuously extended without interruption, thus enhancing the lighting effect.

In another example, as shown in FIG. 13, the light apparatus 100 may be configured in such a way that a plurality of electric units 150 are arranged in a lateral direction of the rail unit 110. In this case, the light apparatus 100 not only can achieve the purpose of providing brighter lighting to a desired place but can also embody a surface light source structure that diffuses light into a surface form.

In the lighting apparatus 100 having the above-mentioned configuration, each of the electric units 150 can be adjusted in position on the corresponding rail unit 110, and power can be reliably supplied from the rail unit 110 to the electric unit 150. Therefore, the present invention can be effectively used as lighting for several places, such as a place with a comparatively large area, or a place where intensely bright lighting is required.

Furthermore, in the lighting apparatus 100 according to this embodiment, power is supplied to the electric unit 150 by electrical connection between the electrodes 130 and the power connectors 180 which are not exposed to the outside. Therefore, power can be reliably supplied to the electric unit 150 without using a separate wire for supply of power to the electric unit 150.

In this way, the present invention can provide the lighting apparatus 100 which not only has a structure in which power can be reliably supplied to the electric unit 150, but which also has a stylish and simple appearance. Furthermore, a separate element such as a wire is not required in the installation of the electric unit 150 so that a potential problem of interference between the electric unit 150 and the separate element can be avoided, allowing adjustment of the position of lighting can be facilitated and precisely conducted.

Figure 14:
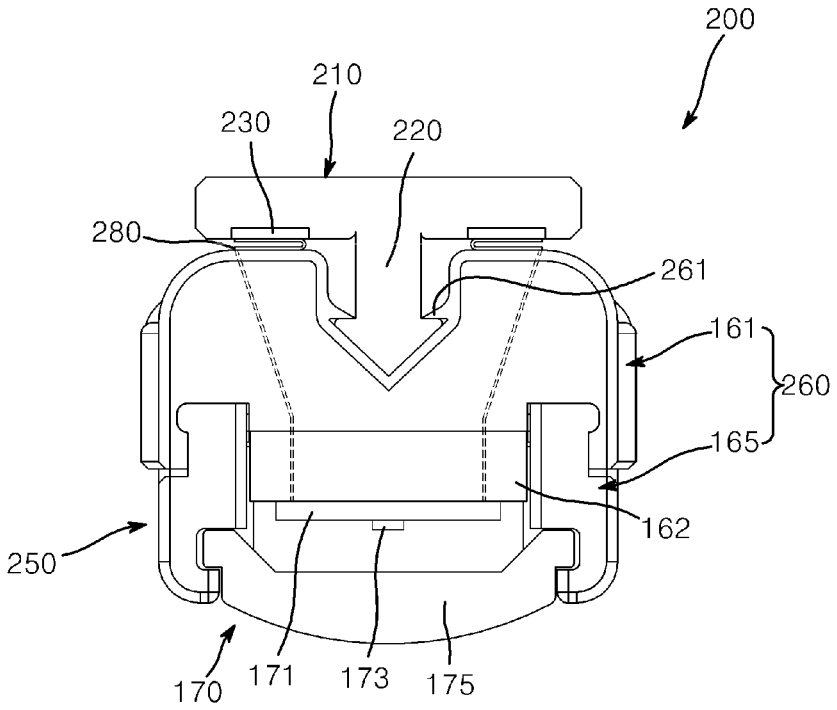
FIG. 14 is a side view illustrating a lighting apparatus according to a second embodiment of the present invention.
Figure 15:
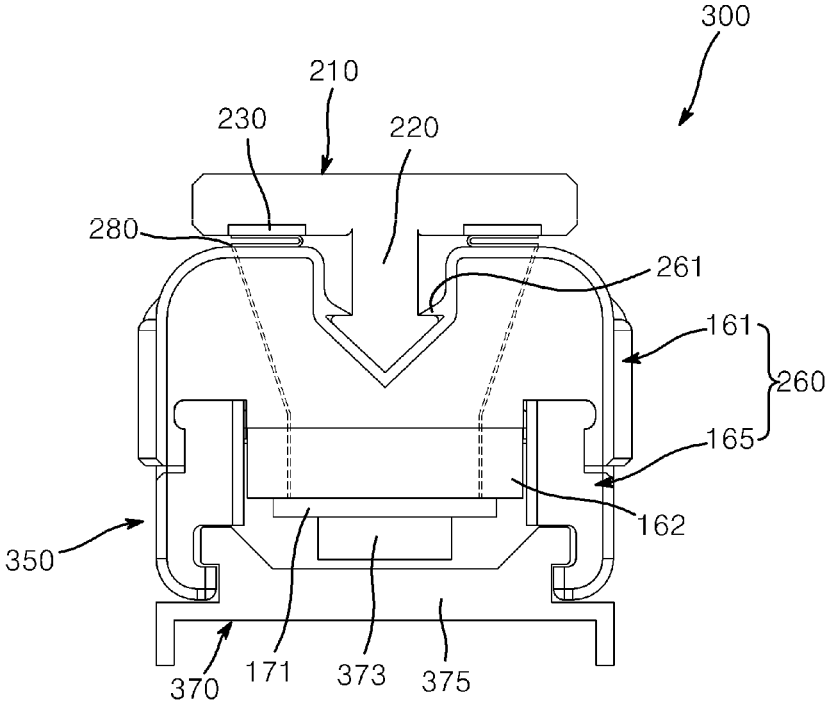
FIG. 15 is a side view illustrating a lighting apparatus according to a third embodiment of the present invention.
Figure 16:
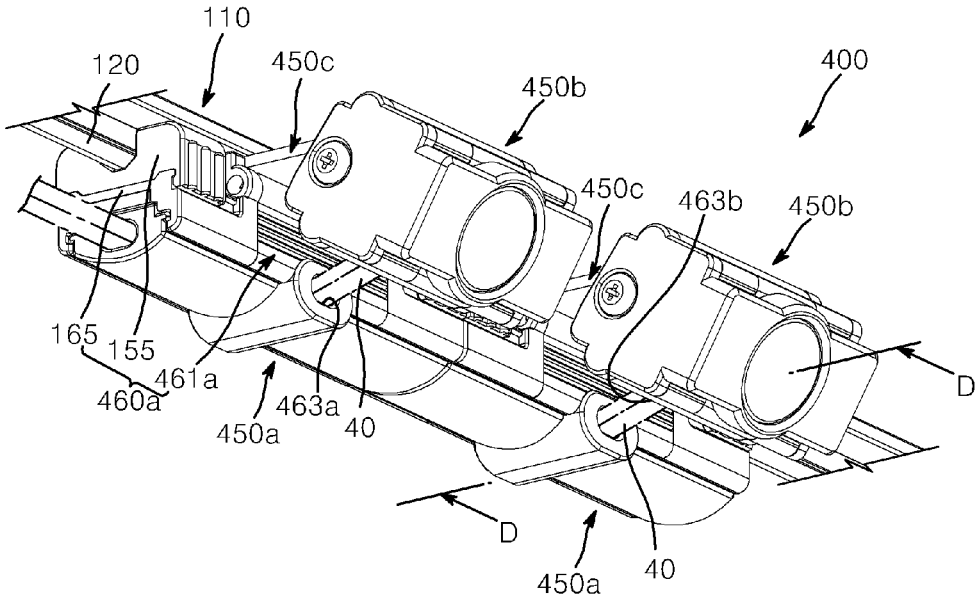
FIG. 16 is a perspective view illustrating a lighting apparatus according to a fourth embodiment of the present invention.
Figure 17:
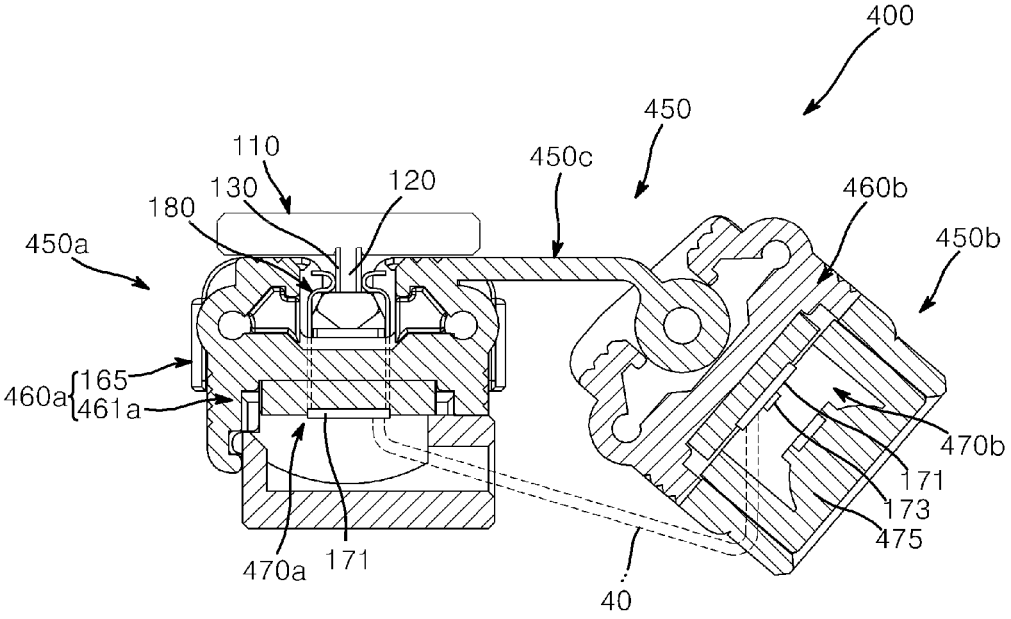
FIG. 17 is a sectional view taken along line D-D of FIG. 16.
Figure 18:
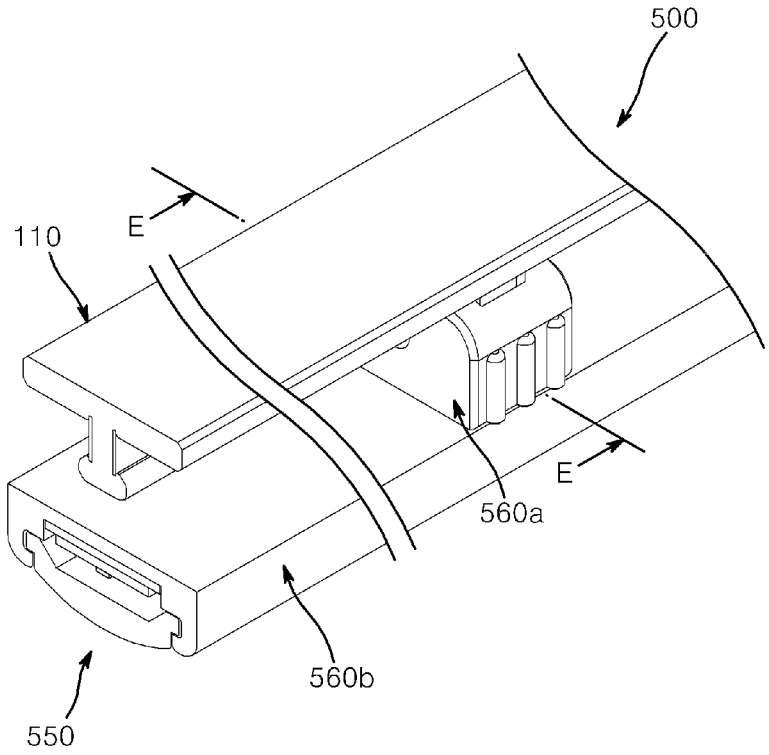
FIG. 18 is a schematic perspective view showing a lighting apparatus according to a fifth embodiment of the present invention.
Figure 19:
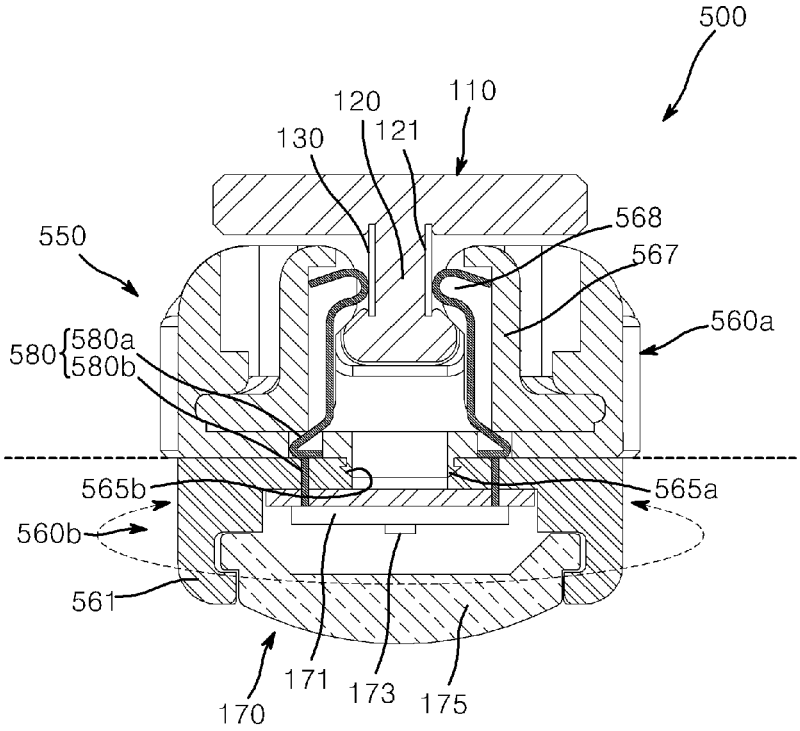
FIG. 19 is a sectional view taken along line E-E of FIG. 18.
Figure 20:
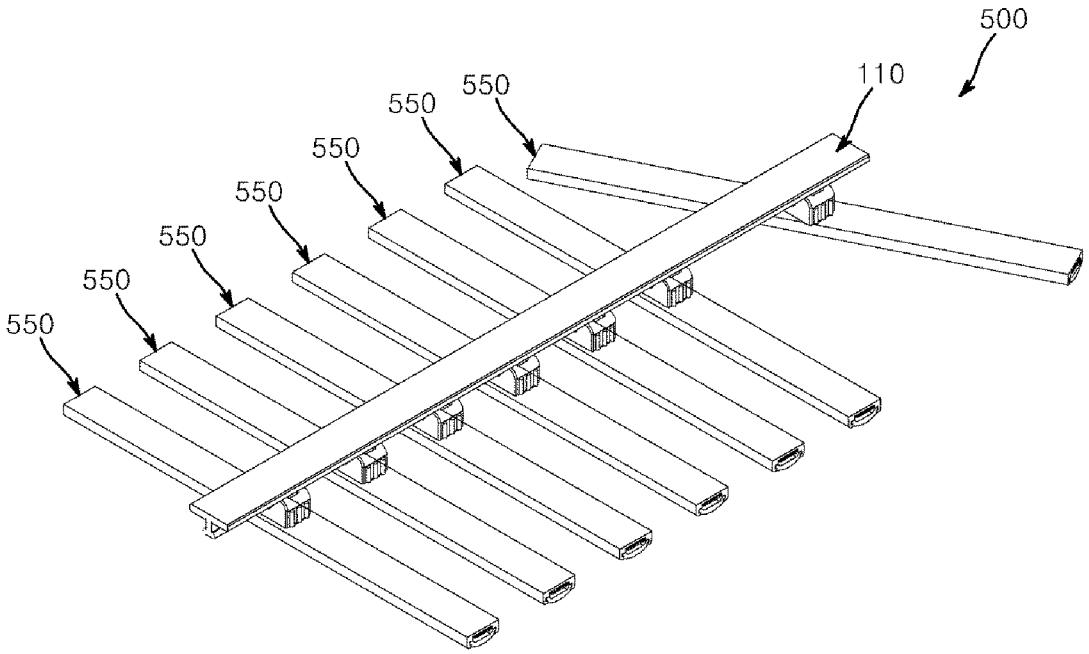
FIG. 20 is a view showing an example of use of the lighting apparatus according to the fifth embodiment of the present invention.
Figure 21:
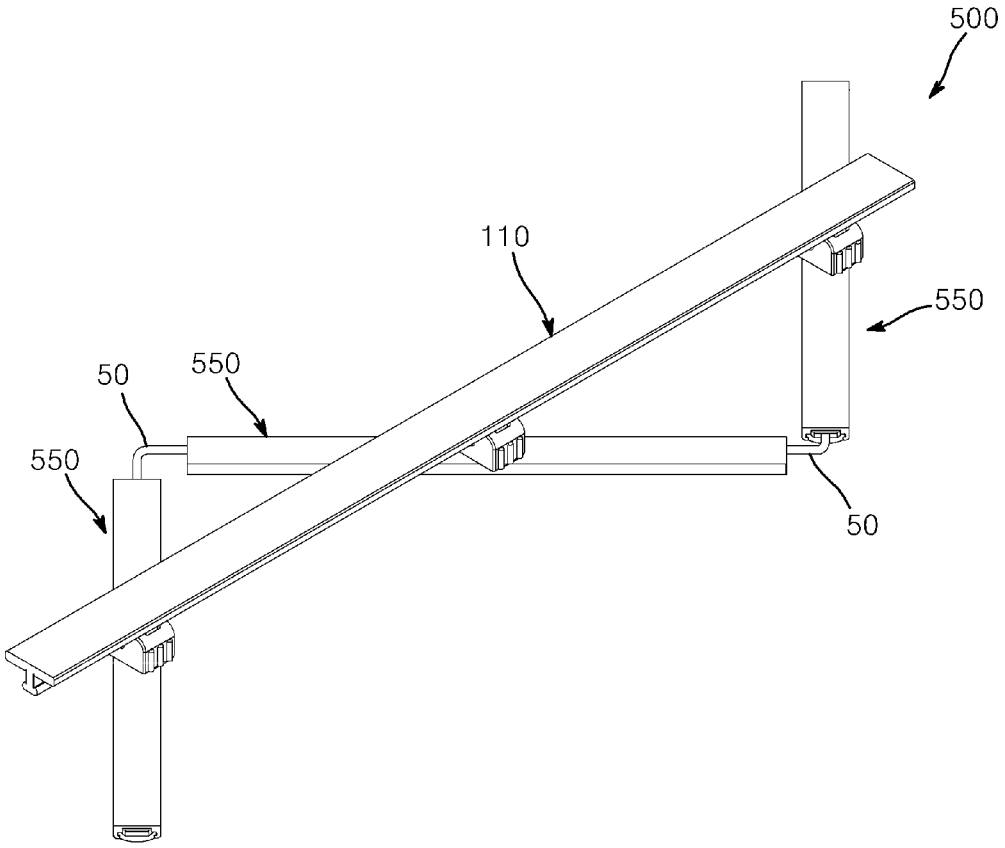
FIG. 21 is a view showing another example of the lighting apparatus in use according to the fifth embodiment of the present invention.
Figure 22:
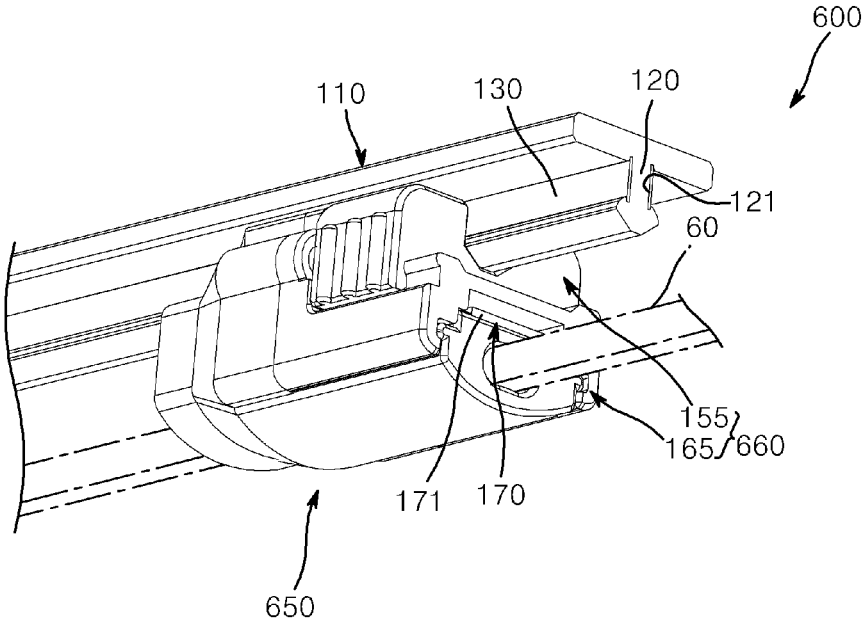
FIG. 22 is a perspective view showing a lighting apparatus according to a sixth embodiment of the present invention.
Figure 23:
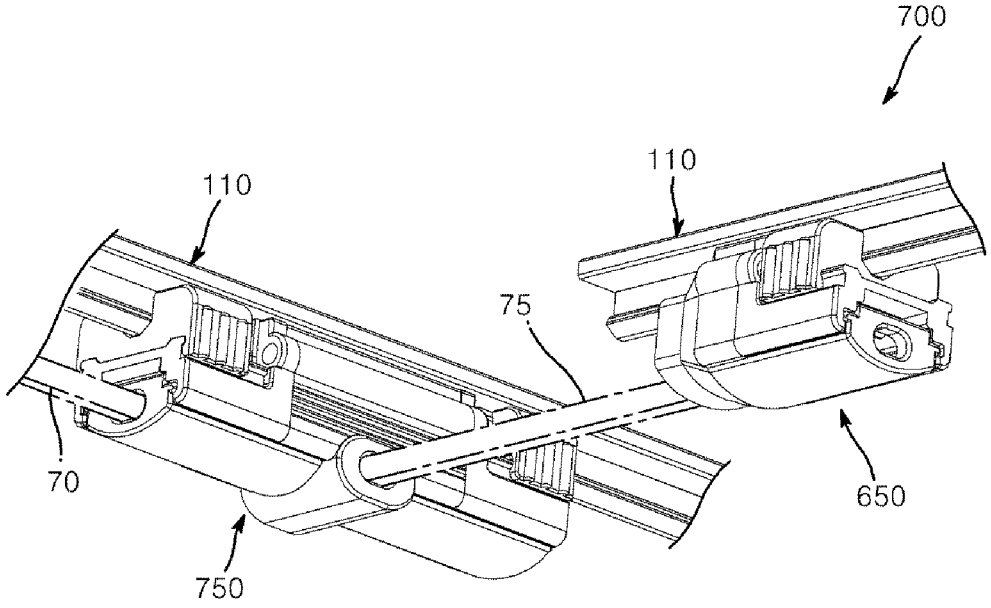
FIG. 23 is a perspective view showing a lighting apparatus according to a seventh embodiment of the present invention.
Figure 24:
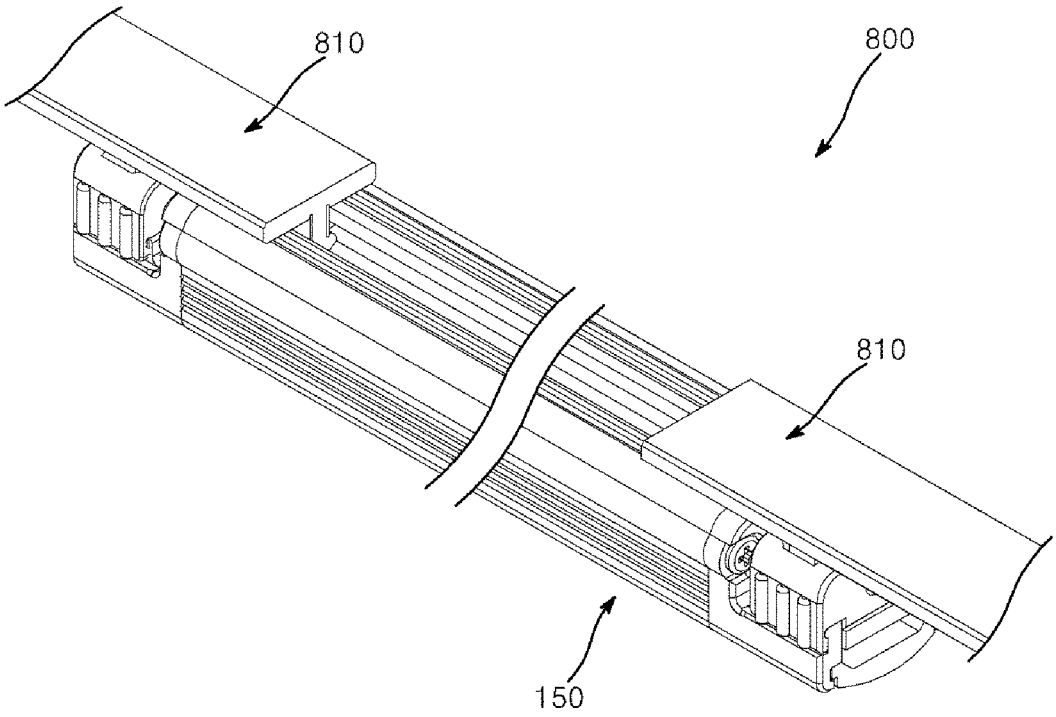
FIG. 24 is a perspective view showing a lighting apparatus according to an eighth embodiment of the present invention.
Figure 25:
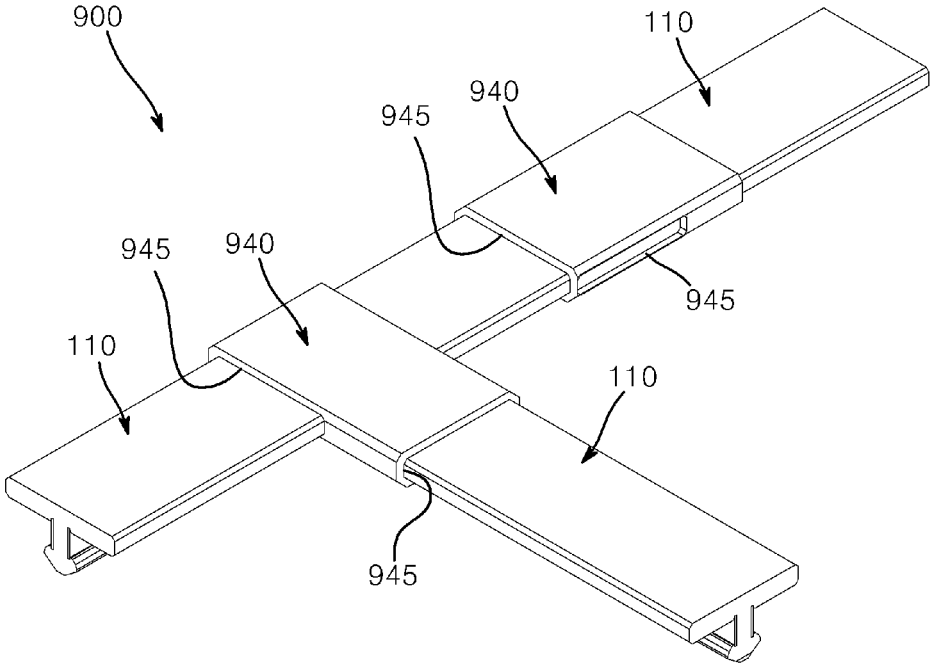
FIG. 25 is a perspective view showing a lighting apparatus according to a ninth embodiment of the present invention.
Figure 26:
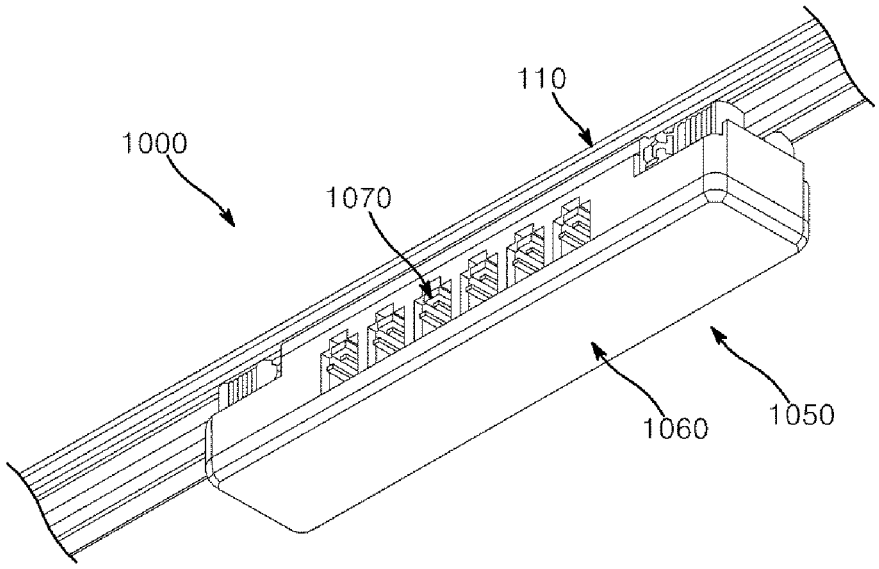
FIG. 26 is a perspective view showing a lighting apparatus according to a tenth embodiment of the present invention.

FIG. 14 is a side view illustrating a lighting apparatus according to a second embodiment of the present invention. FIG. 15 is a side view illustrating a lighting apparatus according to a third embodiment of the present invention. FIG. 16 is a perspective view illustrating a lighting apparatus according to a fourth embodiment of the present invention. FIG. 17 is a sectional view taken along line D-D of FIG. 16. FIG. 18 is a schematic perspective view showing a lighting apparatus according to a fifth embodiment of the present invention. FIG. 19 is a sectional view taken along line E-E of FIG. 18. FIG. 20 is a view showing an example of a use of the lighting apparatus according to the fifth embodiment of the present invention. FIG. 21 is a view showing another example of use of the lighting apparatus according to the fifth embodiment of the present invention. FIG. 22 is a perspective view showing a lighting apparatus according to a sixth embodiment of the present invention. FIG. 23 is a perspective view showing a lighting apparatus according to a seventh embodiment of the present invention. FIG. 24 is a perspective view showing a lighting apparatus according to an eighth embodiment of the present invention. FIG. 25 is a perspective view showing a lighting apparatus according to a ninth embodiment of the present invention. FIG. 26 is a perspective view showing a lighting apparatus according to a tenth embodiment of the present invention.

Hereinafter, lighting apparatuses according to the second through tenth embodiments of the present invention will be described in detail with reference to FIGS. 14 through 26. The same reference numerals as those of the previous drawings denote the same elements having the same functions, and detailed descriptions for those will be omitted for the sake of repeated explanation.

Referring to FIG. 14, the lighting apparatus 200, according to the second embodiment of the present invention, includes a rail unit 210 and an electric unit 250.

The rail unit 210 includes a guide rail 220 and electrodes 230. The electrodes 230 are installed on the guide rail 220, in more detail, under a lower surface of the guide rail 220. Each electrode 230 extends in a longitudinal direction of the guide rail 220 to have a length corresponding to that of the guide rail 220. The electrodes 230 are electrically connected to an external power supply (not shown) so that power is supplied from the external power supply to the electrodes 230.

The electric unit 250 includes a body unit 260, a module unit 170, and power connectors 280. The body unit 260 is removable and movably coupled to the rail unit 210. The power connectors 280 are installed on the body unit 260, in more detail, on an upper surface of the body unit 260 that faces the lower surface of the guide rail 220. The power connectors 280 come into contact with the respective electrodes 230 with respect to a vertical orientation, receive power from the electrodes 230, and supply the power to the module unit 170. An elastic force application structure of the power connectors 280 and an electrical connection structure between the power connectors 280 and the module unit 170 are almost the same as those of the power connectors (180; refer to FIG. 10) of the first embodiment. Therefore, further explanation is deemed unnecessary.

In the electric unit 250, according to the second embodiment, because the power connectors 280 and the electrodes 230 make contact with each other in the same direction as the direction in which the rail unit 210 and the body unit 260 are coupled to each other, the connection between the power connectors 280 and the electrodes 230 are more reliable. Thereby, supply of electricity to the electric unit 250 is more reliably embodied.

Meanwhile, an end of the guide rail 220 has an arrowhead shape which is pointed towards the body unit 260. A locking protrusion 261, to which the guide rail 220 is locked when inserted into the body unit 260, is provided in the body unit 260.

Preferably, the locking protrusion 261 is configured such that it can be elastically bent towards the inside of the body unit 260 by a pressing force which is applied to the locking protrusion 261 from the guide rail 220 which is being inserted into the body unit 260. When the guide rail 220 is completely inserted into the body unit 260 after completely passing through the locking protrusion 261, the locking protrusion 261 catches the guide rail 220, whereby the insertion of the guide rail 220 in the body unit 260 is reliably maintained.

In this state, when force of a predetermined magnitude or more is applied to the body unit 260 in a direction in which the guide rail 220 is removed from the body unit 260, the locking protrusion 261 is bent outwards from the body unit 260 and thus releases the guide rail 220, whereby the guide rail 220 can be separated from the body unit 260.

By virtue of removable coupling method between the guide rail 220 and the body unit 260, the electric unit 250 can be installed on the rail unit 210 so as to be adjustable in position with respect to the longitudinal direction of the rail unit 210.

Referring to FIG. 15, the lighting apparatus 300 according to the third embodiment of the present invention includes a rail unit 210 and an electric unit 350.

The electric unit 350 includes a body unit 260, a module unit 370 and a power connector 280. The module unit 370 includes a circuit board unit 171, a connection unit 373 and a bracket 375.

The connection unit 373 is installed on the circuit board unit 171 and is electrically connected to the circuit board unit 171, which is electrically connected to the power connector 280 so that power can be supplied to the connection unit 373 through the circuit board unit 171. The connection unit 373 is electrically connected to an external device (not shown), which is installed on the bracket 375, thus supplying power to the external device.

The bracket 375 is installed on a module installation body 161 and a coupling cover 165 of the body unit 260. Different kinds of external devices such as sensors or small cameras can be installed on the bracket 375. Such external devices that are installed on the bracket 375 are electrically connected to the connection unit 373 through a connection member such as a cable and are able to be operated by power supplied through the connection unit 373.

Referring to FIGS. 16 and 17, a lighting apparatus 400 according to the fourth embodiment of the present invention includes a rail unit 110 and an electric unit 450.

The electric unit 450 includes a power supply unit 450*a* and a lighting unit 450*b*.

The power supply unit 450*a* is coupled to the rail unit 110 and is brought into contact with the rail unit 110 so that power can be supplied from the rail unit 110 to the power supply unit 450*a*. The power supply unit 450*a* includes a body unit 460*a*, a module unit 470*a*, and power connectors 180.

The body unit 460*a* includes a module installation body 461*a*, a coupling cover 165, and a pressure cover 155.

The module installation body 461*a* is provided to receive the module unit 470*a* therein. A first opening hole 463*a* is formed in a side surface of the module unit 470*a*.

The module unit 470*a* is installed in the module installation body 461*a*. The module unit 470*a*, provided in the module installation body 461*a*, is electrically connected to the power connector 180. In this embodiment, the module unit 470*a* is illustrated as having a structure including a circuit board unit 171 therein. In another example, the module unit 470*a* may be electrically connected to the power connector 180 without including the circuit board unit 171.

Furthermore, a wire 40 is electrically connected to the module unit 470*a*. The wire 40 is connected at a first end thereof to the module unit 470*a* and extends to the outside of the body unit 460*a* through the first opening hole 463*a*. A second end of the wire 40 which extends out of the body unit 460*a* is electrically connected to the lighting unit 450*b* which will be explained vida infra.

Meanwhile, the electric unit 450 of this embodiment further includes a connection bracket 450*c*. The connection bracket 450*c* functions to connect the lighting unit 450*b* to the power supply unit 450*a* so as to be adjustable at an angle. In this embodiment, the connection bracket 450*c* is illustrated as being configured in such a way that it extends a predetermined length from the body unit 460*a* to the lighting unit 450*b*.

The lighting unit 450*b* is connected to the power supply unit 450*a* so as to be adjustable at an angle. The lighting unit 450*b* includes a body unit 460*b* and a module unit 470*b*.

The body unit 460*b* is provided to receive the module unit 470*b* therein. The body unit 460*b* is rotatably coupled to the connection bracket 450*c*, whereby the body unit 460*b* can be adjusted at an angle with respect to the power supply unit 450*a*. A second opening hole 463*b* is formed in a side surface of the body unit 460*b*.

The module unit 470*b* is disposed in the body unit 460*b*. In this embodiment, the module unit 470*b* is illustrated as including a circuit board unit 171, a light source unit 173 and a diffuser 475. The module unit 470*b* is electrically connected to the power supply unit 450*a* in such a way that the wire 40 that extends into the body unit 460*b* through the second opening hole 463*b* is electrically connected to the circuit board unit 171.

In the case of the electric unit 450 having the above-mentioned construction, the angle of the lighting unit 450*b* can be adjusted such that it is oriented towards an area where lighting is required, thus providing light to the desired area. As described above, in the lighting apparatus 400 of this embodiment including the electric unit 450, because the lighting unit 450*b* can be adjusted in position with respect to the longitudinal direction of the rail unit 110 and be adjusted at an angle based on the rail unit 110, lighting can be realized such that light is provided to a desired area at a desired angle.

Referring to FIGS. 18 and 19, the lighting apparatus 500 according to the fifth embodiment of the present invention includes a rail unit 110 and an electric unit 550. The electric unit 550 includes a first body unit 560*a*, a second body unit 560*b*, a module unit 170, and a power connector 580.

The first body unit 560*a* is movably coupled to the rail unit 110. The first body unit 560*a* includes a first rail coupling part 567 and second rail coupling part 568.

The first rail coupling part 567 is configured in such a way that it encloses the guide rail 120. The second rail coupling part 568 is bent from the first rail coupling part 567 towards the side surfaces of the guide rail 120, and are coupled to the respective coupling depressions 121.

In this embodiment, the first body unit 560*a* engages with the guide rail 120 in such a way that the first body unit 560*a* covers the outer surface of the guide rail 120, whereby the first body unit 560*a* and the guide rail 120 are removably coupled to each other. Here, because the second rail coupling part 568 is inserted into the respective coupling depressions 121, the first body unit 560*a* can be prevented from being undesirably removed from the guide rail 120.

The first body unit 560*a* having the above-mentioned construction is coupled to the guide rail 120 using the first and second rail coupling parts 567 and 568, whereby the second body unit 560*b* and the electric unit 550, including the second body unit 560*b*, can be removably coupled to the rail unit 110.

The second body unit 560*b* is rotatably coupled to the first body unit 560*a*. The second body unit 560*b* includes a module installation body 561 in which the module unit 170 is installed.

To embody the rotatable coupling structure between the first and second body units 560*a* and 560*b* in this embodiment, a rotating coupling protrusion 565*a* is provided on the first body unit 560*a*, and a rotating coupling groove 565*b* is formed in the second body unit 560*b*. The rotating coupling protrusion 565*a* is rotatably inserted into the rotating coupling groove 565*b* so that the second body unit 560*b* can be rotatably coupled to the first body unit 560*a*.

The power connectors 580 make contact with the rail unit 110 and transmit power from the rail unit 110 to the module unit 170. Each power connector 580 includes a first connection part 580*a* and a second connection part 580*b*.

The first connection part 580*a* of each power connector 580 is installed in the first body unit 560*a* and is electrically connected to the corresponding electrode 130. The first connection part 580*a* has a shape similar to that of the power connector (180; refer to FIG. 10) of the first embodiment of the present invention. The first connection part 580*a* is disposed in the first body unit 560*a* in such a way that a first end of the first connection part 580*a* makes contact with the electrode 130, and a second end of the first connection part 580*a* is exposed to the outside from the first body unit 560*a*.

The second connection parts 580*b* are installed in the second body unit 560*b*. A first end of each second connection part 580*b* makes slidable contact with the corresponding first connection part 580*a*. A second end of the second connection part 580*b* is electrically connected to the module unit 170.

In this embodiment, the second end of the first connection part 580*a* is illustrated as being bent. The bent second end of the first connection part 580*a* provides an elastic force that enables the first connection part 580*a* to make close contact with the second connection part 580*b*. The first connection part 580*a* and the second connection part 580*b* can be brought into close contact with each other by the elastic force provided by the first connection part 580*a*.

Meanwhile, the second body unit 560*b* is removably coupled to the first body unit 560*a* by the removable coupling between the rotating coupling protrusion 565*a* and the rotating coupling groove 565*b*. Furthermore, the second body unit 560*b* may be separated from the first body unit 560*a* and disposed at a position spaced apart from the first body unit 560*a* by a predetermined distance.

As shown in FIGS. 19 and 20, in the lighting apparatus 500 of this embodiment, including the electric unit 550, having the above-mentioned construction, the second body unit 560*b* can be rotated on the first body unit 560*a* so that the orientation of the second body unit 560*b* can be adjusted.

That is, as shown in FIGS. 20 and 21, in the lighting apparatus 500 of this embodiment, the position of the electric unit 550 can be changed in the longitudinal direction of the rail unit 110, and the orientation of the electric unit 550 can be changed in a predetermined direction, whereby the orientation and position of lighting can be easily adjusted. Furthermore, the lighting apparatus 500 of this embodiment may be configured such that a plurality of electric units 550 are arranged in the longitudinal direction of the rail unit 110. In this case, because the orientation and position of lighting of each electric unit 550 can be adjusted without restriction, the degree of freedom in the expression of lighting can be enhanced.

Furthermore, as shown in FIG. 21, the lighting apparatus 500 according to this embodiment may be configured such that a plurality of electric units 550 are movably provided on the rail unit 110 and are connected to each other by connectors 50. In this case, the electric units 550 can be folded onto each other or stretched out by pushing or pulling any one of the electric units 550 in the longitudinal direction of the rail unit 110.

Referring to FIG. 22, the lighting apparatus 600, according to sixth embodiment of the present invention, further includes a power cord unit 650. The power cord unit 650 makes contact with the rail unit 110 and supplies power to the rail unit 110. In this embodiment, the power cord unit 650 includes a body unit 660, a module unit 170, and a power connector (180; refer to FIG. 10).

The body unit 660 includes a coupling cover 165 and a pressure cover 155. Detailed explanation of the construction of the coupling cover 165 and the pressure cover 155 will be omitted because it is the same as that of the first embodiment. The body unit 660 is removably coupled to the rail unit 110, whereby the power cord unit 650 can also be removably installed on the rail unit 110.

The module unit 170 includes a circuit board unit 171, which is installed in the coupling cover 165. A wire 60, which is connected to an external power supply (not shown), is electrically connected to the circuit board unit 171. In this embodiment, the external power supply is illustrated as being a switching mode power supply (hereinafter referred to as an 'SMPS'). The SMPS may be provided outside the lighting apparatus 600 as an external power supply or, alternatively, it may be provided in a way that it is installed inside the power cord unit 650.

In this embodiment, power supplied from the external power supply through the wire 60 is applied to the rail unit 110 through the power connectors 180 which electrically connect the circuit board unit 171 to the rail unit 110.

In the lighting apparatus 600, according to this embodiment having the power cord unit 650, which can be removably installed on the rail unit 110, power can be reliably supplied to the rail unit 110 merely by installing the power cord unit 650 on the rail unit 110.

Referring to FIG. 23, the lighting apparatus 700, according to the seventh embodiment of the present invention, further includes a power supply unit 750 and a power cord unit 650.

The power supply unit 750 is coupled to the rail unit 110, receives power from an external power supply (not shown) through a wire 70, and supplies the power to the rail unit 110.

Compared to the power supply unit (450*a*; refer to FIG. 17) of the fourth embodiment, the general construction of the power supply unit 750 of the seventh embodiment, other than having a structure in which the wire 70 is electrically connected to the module unit 470*a*, is essentially the same as that of the power supply unit 450*a*. The detailed construction of the power supply unit 750 can be easily embodied based on the power supply unit 450*a* of the fourth embodiment by those skilled in this art; therefore, further explanation will be omitted.

The power cord unit 650 receives power from the power supply unit 750 through the wire 75 that is electrically connected to the power supply unit 750. Further, the power cord unit 650 is coupled to another rail unit 110, which is separated from the rail unit 110 that is provided with the power supply unit 750, thus supplying power to the separate rail unit 110.

In an example, the power cord unit 650 may be configured in such a way that an SMPS (not shown) is installed in the power cord unit 650. In this case, a plurality of power cord units 650 which are installed on the rail units 110 can be electrically connected in parallel to each other.

Referring to FIG. 24, the lighting apparatus 800, according to the eighth embodiment of the present invention, includes a rail unit 810 and an electric unit 150.

This embodiment is illustrated as being configured such that a plurality of rail units 810 are provided and separated from each other. When the length of a place where it is necessary to install the rail unit 810 is longer than the length of the typical rail unit 810, or when a stepped portion is present on a sidewall or ceiling on which it is required to install the rail unit 810, this embodiment can be used in such a way that rail units 810 are arranged at positions spaced apart from each other.

In this case, the electric unit 150 may be coupled to the adjacent rail units 810, which are spaced apart from each other by a predetermined distance, in such a way that one end of the electric unit 150 is coupled to one of the adjacent rail units 810 and the other end thereof is coupled to the other rail unit 810.

Thanks to the above-mentioned installation structure, even when the length of the rail unit 810 is shorter than a length of a place where it is required to install the rail unit 810, the lighting apparatus 800 according to the eighth embodiment of the present invention can be easily installed on a target surface. Moreover, even if a target surface is uneven, the lighting apparatus 800 can be easily installed on the target surface.

Referring to FIG. 25, the lighting apparatus 900, according to the ninth embodiment of the present invention, further includes a coupler 940. The coupler 940 functions to couple a plurality of rail units 110 to each other. In this embodiment, the rail units 110 are illustrated as being inserted into the corresponding couplers 940 so that the rail units 110 are connected to each other by the couplers 940.

The coupler 940 may connect the rail units 110 to each other in the longitudinal direction of the rail units 110. Alternatively, the coupler 940 may connect the rail units 110 to each other in a direction in which the rail units 110 cross each other. The direction in which the rail units 110 are connected to each other is determined depending on positions at which insert holes 945 are formed in the coupler 940 such that the rail units 110 can be inserted into the coupler 940 through the insert holes 945.

In this embodiment, the coupler 940 may be made of conductive material or, alternatively, it may be made of nonconductive material. In the case where the coupler 940 is made of conductive material, a plurality of rail units 110 can be electrically connected to each other by the coupler 940. If the coupler 940 is made of nonconductive material, the rail units 110 which are connected to each other by the coupler 940 can be electrically insulated from each other.

As such, the coupler 940 can reliably couple the rail units 110 to each other so that the entire length of the lighting apparatus 900 can be optionally extended. Furthermore, the rail units 110 can be connected to each other in a variety of shapes including not only a linear shape, but also a bent shape, whereby the degree of freedom of installation of the lighting apparatus 900 can be enhanced.

Referring to FIG. 26, the lighting apparatus 1000, according to the tenth embodiment of the present invention, includes a rail unit 110 and an electric unit 1050. The electric unit 1050 includes a body unit 1060, a power distribution unit 1070 and a power connector 180.

The body unit 1060 is movably coupled to the rail unit 110. The structure of coupling the body unit 1060 to the rail unit 110 and the structure of electrically connecting the body unit 1060 to the rail unit 110 through the power connector 180 are the same as those of the body unit (160; refer to FIG. 10) and the power connector (180; refer to FIG. 10) of the first embodiment; therefore, further explanation will be omitted.

The power distribution unit 1070 is installed on the body unit 160 and supplies power to an external device (not shown). The power distribution unit 1070 is electrically connected to the power connector 180, which makes contact with the rail unit 110 and receives power from the rail unit 110, so that power is supplied from the power connector 180 to the power distribution unit 1070.

The power distribution unit 1070 having the above-mentioned construction may be configured to have a socket, a USB terminal, etc. The power distribution unit 1070 is electrically connected to an external device in such a way that the external device is directly coupled to the power distribution unit 1070 or coupled thereto by a connection wire. In this way, the power distribution unit 1070 can supply power to various types of external devices such as other lighting apparatuses, sensors, small cameras, etc.

In the lighting apparatus 1000 according to this embodiment including the power distribution unit 1070, by virtue of the electric unit 1050 which can be moved to various positions along the rail unit 110, the lighting apparatus 1000 can function not only as a lighting apparatus, but also as a charging means at various positions without being limited to a specific position. Therefore, the lighting apparatus 1000 according to this embodiment can be more convenient for users.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A lighting apparatus, comprising:

a rail unit; and an electric unit installed on the rail unit so as to be adjustable in position, the electric unit making contact with the rail unit and receiving power from the rail unit, wherein the electric unit comprises:

a body unit coupled to the rail unit;

a module unit installed in the body unit; and a power connector making contact with the rail unit and receiving power from the rail unit, the power connector supplying power to the module unit, wherein the module unit comprises:

a circuit board unit installed in the body unit, the circuit board unit making contact with the power connector and receiving power from the power connector;

a connection unit installed on the circuit board unit, the connection unit receiving power from the circuit board unit; and a bracket installed on the body unit to couple an external device to the bracket.

2. A lighting apparatus, comprising:

a rail unit; and an electric unit installed on the rail unit so as to be adjustable in position, the electric unit making contact with the rail unit and receiving power from the rail unit, wherein the electric unit comprises:

a body unit coupled to the rail unit;

a module unit installed in the body unit; and a power connector making contact with the rail unit and receiving power from the rail unit, the power connector supplying power to the module unit, wherein the rail unit comprises:

a guide rail to which the body unit is coupled; and an electrode provided on the guide rail, the electrode making contact with the power connector and supplying power to the power connector, wherein the body unit comprises:

a module installation body in which the module unit is installed; and a coupling cover coupling the module installation body to the rail unit, wherein the guide rail has a coupling depression formed in a side surface of the guide rail, the coupling depression extending along a longitudinal direction of the guide rail, and the coupling cover comprises:

a body coupling part coupled to the module installation body;

a first rail coupling part provided in such a way that the first rail coupling part encloses an outer surface of the guide rail; and a second rail coupling part extending and bending from the first rail coupling part, the second rail coupling part being coupled to the coupling depression.

3. A lighting apparatus, comprising:

a rail unit; and an electric unit installed on the rail unit so as to be adjustable in position, the electric unit making contact with the rail unit and receiving power from the rail unit, wherein the electric unit comprises:

a first body unit coupled to the rail unit;

a second body unit rotatably coupled to the first body unit;

a module unit installed in the second body unit; and a power connector making contact with the rail unit and receiving power from the rail unit, the power connector supplying the power to the module unit, wherein the power connector comprises: a first connection part installed in the first body unit and electrically connected to the rail unit; and a second connection part installed in the second body unit, the second connection part having a first end making slidable contact with the first connection part, and a second end electrically connected to the module unit, wherein the rail unit comprises:

a guide rail to which the first body unit is coupled; and an electrode provided on the guide rail, the electrode making contact with the power connector and supplying power to the power connector, wherein the first body unit comprises:

a module installation body in which the module unit is installed; and a coupling cover coupling the module installation body to the rail unit, wherein the guide rail has a coupling depression formed in a side surface of the guide rail, the coupling depression extending along a longitudinal direction of the guide rail, and the coupling cover comprises:

a body coupling part coupled to the module installation body;

a first rail coupling part provided in such a way that the first rail coupling part encloses an outer surface of the guide rail; and a second rail coupling part extending and bending from the first rail coupling part, the second rail coupling part being coupled to the coupling depression.

4. The lighting apparatus as set forth in claim 1, wherein the rail unit comprises:

a guide rail to which the body unit is coupled; and an electrode provided on the guide rail, the electrode making contact with the power connector and supplying power to the power connector.

5. The lighting apparatus as set forth in claim 1, wherein the rail unit comprises a plurality of rail units, the lighting apparatus further comprising a coupler for coupling the rail units to each other.

6. The lighting apparatus as set forth in claim 1, further comprising a power cord unit making contact with the rail unit and supplying power to the rail unit.

7. The lighting apparatus as set forth in claim 2, wherein the module unit comprises:

a circuit board unit installed in the body unit, the circuit board making contact with the power connector and receiving power from the power connector;

a light source unit installed on the circuit board unit, the light source unit emitting light; and a diffuser installed in the body unit, the diffuser diffusing the light emitted from the light source unit.

8. The lighting apparatus as set forth in claim 2, wherein the module unit comprises:

a circuit board unit installed in the body unit, the circuit board unit making contact with the power connector and receiving power from the power connector;

a connection unit installed on the circuit board unit, the connection unit receiving power from the circuit board unit; and a bracket installed on the body unit to couple an external device to the bracket.

9. The lighting apparatus as set forth in claim 2, wherein the rail unit comprises a plurality of rail units, the lighting apparatus further comprising a coupler for coupling the rail units to each other.

10. The lighting apparatus as set forth in claim 2, further comprising a power cord unit making contact with the rail unit and supplying power to the rail unit.

11. The lighting apparatus as set forth in claim 2, wherein the body unit further comprises a pressure cover installed on the coupling cover, the pressure cover compressing the first and second rail coupling parts towards the coupling depression.

12. The lighting apparatus as set forth in claim 4, wherein the body unit comprises:

a module installation body in which the module unit is installed; and a coupling cover coupling the module installation body to the rail unit.

13. The lighting apparatus as set forth in claim 11, wherein the pressure cover comprises:

a sliding coupling part slidably coupled to the coupling cover so that the pressure cover can be moved to a pressure position or a pressure release position; and a pressure protrusion protruding towards the first rail coupling part, the pressure protrusion coming into contact with the first rail coupling part in conjunction with sliding movement of the sliding coupling part and compressing the first rail coupling part towards the coupling depression.

14. The lighting apparatus as set forth in claim 12, wherein the power connector comprises:

a first connection part electrically connected to the electrode;

a second connection part electrically connected to the first connection part; and a third connection part extended from the second connection part to be electrically connected to the module unit.

15. The lighting apparatus as set forth in claim 12, wherein the guide rail has a coupling depression formed in a side surface of the guide rail, the coupling depression extending along a longitudinal direction of the guide rail, and the coupling cover comprises:

a body coupling part coupled to the module installation body;

a first rail coupling part provided in such a way that the first rail coupling part encloses an outer surface of the guide rail; and a second rail coupling part extending and bending from the first rail coupling part, the second rail coupling part being coupled to the coupling depression.

16. The lighting apparatus as set forth in claim 15, wherein the body unit further comprises a pressure cover installed on the coupling cover, the pressure cover compressing the first and second rail coupling parts towards the coupling depression.

17. The lighting apparatus as set forth in claim 16, wherein the pressure cover comprises:

a sliding coupling part slidably coupled to the coupling cover so that the pressure cover can be moved to a pressure position or a pressure release position; and a pressure protrusion protruding towards the first rail coupling part, the pressure protrusion coming into contact with the first rail coupling part in conjunction with sliding movement of the sliding coupling part and compressing the first rail coupling part towards the coupling depression.

* * * * *